US009819117B2

(12) United States Patent
Rollmann et al.

(10) Patent No.: US 9,819,117 B2
(45) **Date of Patent: *Nov. 14, 2017**

(54) POWER CONNECTOR, AND ELECTRICAL CONNECTION ELEMENT AND ASSEMBLY METHOD THEREFOR

(71) Applicant: EATON CORPORATION, Cleveland, OH (US)

(72) Inventors: Paul Jason Rollmann, Menomonee Falls, WI (US); Mark Allan Juds, New Berlin, WI (US); Kurt Von Eckroth, Wales, WI (US)

(73) Assignee: EATON CORPORATION, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/250,026

(22) Filed: Aug. 29, 2016

(65) Prior Publication Data

US 2017/0018872 A1 Jan. 19, 2017

Related U.S. Application Data

(63) Continuation of application No. 14/800,776, filed on Jul. 16, 2015, now Pat. No. 9,472,892.

(51) Int. Cl.

| | |
|---|---|
| ***H01R 13/10*** | (2006.01) |
| ***H01R 13/53*** | (2006.01) |
| ***H01R 13/635*** | (2006.01) |
| ***H01R 13/703*** | (2006.01) |
| ***H01R 13/42*** | (2006.01) |
| ***H01R 13/629*** | (2006.01) |
| ***H01R 43/16*** | (2006.01) |

(52) U.S. Cl.
CPC ..... *H01R 13/53* (2013.01); *H01R 13/42* (2013.01); *H01R 13/62977* (2013.01); *H01R 13/635* (2013.01); *H01R 13/703* (2013.01); *H01R 13/7036* (2013.01); *H01R 43/16* (2013.01)

(58) Field of Classification Search
CPC ..... H01R 23/725; H01R 13/2442
USPC ..... 439/682, 626, 507, 512, 660, 947
See application file for complete search history.

(56) References Cited

U.S. PATENT DOCUMENTS 8,016,604 B2 * 9/2011 Matsumoto ..... B60L 3/0069 439/304
8,419,477 B1 4/2013 Yu et al.
(Continued)

*Primary Examiner* — Phuong Chi T Nguyen
(74) *Attorney, Agent, or Firm* — Eckert Seamans; John Powers; Grant Coffield

(57) ABSTRACT

An electrical connection element is for a power connector. The power connector has an electrical component including a first insulative housing and a first mating assembly having a number of first electrical mating members structured to be substantially enclosed by the first insulative housing. The electrical connection element includes a second insulative housing; and a second mating assembly comprising a number of second electrical mating members structured to be electrically connected to the number of first electrical mating members. The second mating assembly is structured to move between a first position corresponding to the number of second electrical mating members being substantially enclosed by the second insulative housing, and a second position corresponding to the number of second electrical mating members being partially disposed external the second insulative housing.

12 Claims, 13 Drawing Sheets

(56) References Cited

U.S. PATENT DOCUMENTS

| | | | | |
|---|---|---|---|---|
| 8,545,270 | B2 | 10/2013 | Yu et al. | |
| 8,574,015 | B2 | 11/2013 | Tai et al. | |
| 8,641,456 | B2 | 2/2014 | Wu et al. | |
| 8,821,184 | B2 | 9/2014 | Yu et al. | |
| 8,926,375 | B2 | 1/2015 | Chen et al. | |
| 9,472,892 | B1 * | 10/2016 | Rollmann ..... | H01R 13/53 |

* cited by examiner

POWER CONNECTOR, AND ELECTRICAL CONNECTION ELEMENT AND ASSEMBLY METHOD THEREFOR

CROSS-REFERENCE TO RELATED APPLICATION

This application is a continuation of U.S. patent application Ser. No. 14/800,776, filed on Jul. 16, 2015, and entitled "POWER CONNECTOR, AND ELECTRICAL CONNECTION ELEMENT AND ASSEMBLY METHOD THEREFOR."

BACKGROUND

Field

The disclosed concept pertains generally to power connectors. The disclosed concept also pertains to electrical connection elements for power connectors. The disclosed concept further pertains to methods of assembling power connectors.

Background Information

Power connectors are used in many different electrical applications, such as, for example, in commercial applications (e.g., employed with stoves and fryers) and in shipping industries (e.g., with refrigeration equipment). Typically, power connectors include a line side receptacle, which is electrically connected to a power source, and a load side receptacle. The line side receptacle has a number of metallic sleeves. The load side receptacle has a number of metallic pins. In operation, the pins are inserted into the sleeves in order to provide an electrical pathway between the line side receptacle and the load side receptacle.

In many systems that employ power connectors such as, for example, solar energy systems, wind power systems and/or generators, it is common for there to be bi-directional power flow. A consequence of such bi-directional power flow is the presence of live accessible energy in the pins of the load side receptacle. Power connectors in such situations are unsafe, as inadvertent contact with the electrically "hot" (e.g., electrically live) pins can cause severe injury to an operator.

There is thus room for improvement in power connectors and in electrical connection elements therefor.

There is also room for improvement in methods of assembling power connectors.

SUMMARY

These needs and others are met by embodiments of the disclosed concept, which are directed to a power connector, and electrical connection element and assembly method therefor in which a mating assembly is structured to move between positions in order to protect operators from inadvertent contact with potentially dangerous electrical mating members.

In accordance with one aspect of the disclosed concept, an electrical connection element for a power connector is provided. The power connector has an electrical component including a first insulative housing and a first mating assembly having a number of first electrical mating members structured to be substantially enclosed by the first insulative housing. The electrical connection element includes a second insulative housing; and a second mating assembly comprising a number of second electrical mating members structured to be electrically connected to the number of first electrical mating members. The second mating assembly is structured to move between a first position corresponding to the number of second electrical mating members being substantially enclosed by the second insulative housing, and a second position corresponding to the number of second electrical mating members being partially disposed external the second insulative housing.

In accordance with another aspect of the disclosed concept, a power connector including the aforementioned electrical connection element, and an assembly method are provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
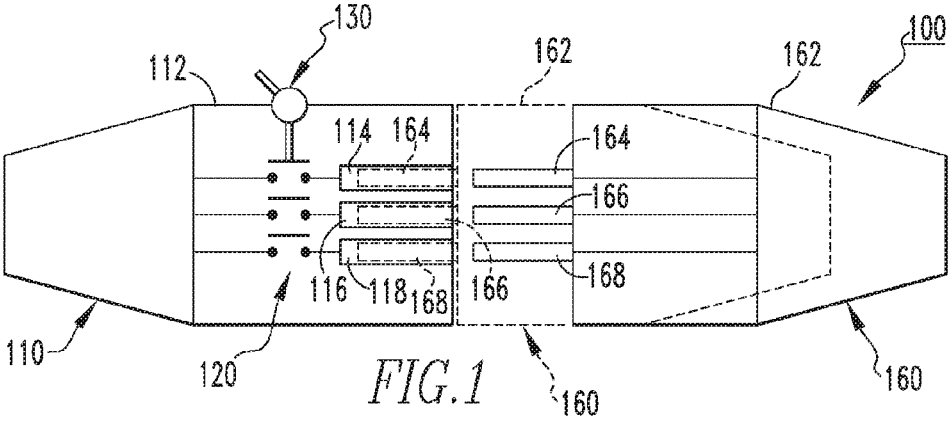
FIG. 1 is a simplified view of a power connector and electrical connection element therefor, in accordance with a non-limiting embodiment of the disclosed concept.

For purposes of the description hereinafter, directional phrases used herein such as, for example, "clockwise," "counterclockwise," "up," "down," and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the term "number" shall mean one or an integer greater than one (i.e., a plurality).

As employed herein, the term "conductor" shall mean a member, such as a copper conductor, an aluminum conductor, a suitable metal conductor, or other suitable material or object that permits an electric current to flow easily.

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

FIG. 1 shows a simplified view of a power connector 100, employing an electrical connection element (e.g., without limitation, line side electrical receptacle 110) and an electrical component (e.g., without limitation, load side electrical receptacle 160) in accordance with one non-limiting example embodiment of the disclosed concept. In the example shown, the line side electrical receptacle 110 includes a housing 112 that has a number of electrical mating members, such as the example female conductors (e.g., without limitation, sleeves 114,116,118). The load side electrical receptacle 160 has a housing 162 that has a number of electrical mating members, such as the example male conductors (e.g., without limitation, pins 164,166,168).

The load side electrical receptacle 160 is also shown in dashed line drawing mechanically coupled to the line side electrical receptacle 110. In operation, and as shown in dashed line drawing, each of the pins 164,166,168 is located within (i.e., as a result of being inserted into) a corresponding one of the sleeves 114,116,118 in order to mechanically couple the load side electrical receptacle 160 to the line side electrical receptacle 110. In known power connectors (not shown), inserting pins (not shown) into corresponding sleeves (not shown) may result in "hot plugging," as discussed above. However, in accordance with the disclosed concept, and as will be discussed in greater detail below, the line side electrical receptacle 110 further includes a contact assembly 120 and an operating mechanism (e.g., without limitation, manual operating lever 130) that advantageously allow the switching energy, which occurs when current first begins to flow freely or first stops flowing freely, to be located in the contact assembly 120, rather than at the connection between the pins 164,166,168 and the sleeves 114,116,118. In this manner, the pins 164,166,168 and the sleeves 114,116,118 are advantageously well-protected against undesirable melting, and/or being welded together, and/or damage to the respective surfaces, and/or an arc flash.

The contact assembly 120 is enclosed by the housing 112 and is electrically connected to the sleeves 114,116,118. In the non-limiting example shown, the manual operating lever 130 is coupled to the housing 112 and the contact assembly 120. Furthermore, the manual operating lever 130 opens and closes the contact assembly 120. The contact assembly 120 is structured to electrically connect and disconnect power when the pins 164,166,168 remain mechanically coupled to (i.e., are inserted within) the sleeves 114,116,118. That is, the pins 164,166,168 and the sleeves 114,116,118 engage before the contact assembly 120 is closed, and disengage after the contact assembly 120 is opened. As a result, current is prevented from switching directly from (i.e., "jumping from", "arcing from") the sleeves 114,116,118 to the pins 164,166,168. Rather, because the pins 164,166,168 and the sleeves 114,116,118 are already engaged, current advantageously experiences relatively little electrical resistance when flowing from the sleeves 114,116,118 to the pins 164,166,168, distinct from known power connectors (not shown) in which initial alignment and engagement of pins (not shown) with electrically hot (e.g., electrically live) sleeves (not shown) results in undesirably large electrical arc energy.

A method of operating the power connector 100 includes the steps of mechanically coupling the pins 164,166,168 to the sleeves 114,116,118 (i.e., inserting the pins 164,166,168 into the sleeves 114,116,118); closing the contact assembly 120 in order to electrically connect power after the pins 164,166,168 are mechanically coupled to the sleeves 114, 116,118; and opening the contact assembly 120 in order to electrically disconnect power while the pins 164,166,168 are mechanically coupled to (i.e., remain inserted within) the sleeves 114,116,118. In this manner, the relatively high switching energy associated with electrically connecting power are advantageously not located at the connection between the pins 164,166,168 and the sleeves 114,116,118.

Figure 2:
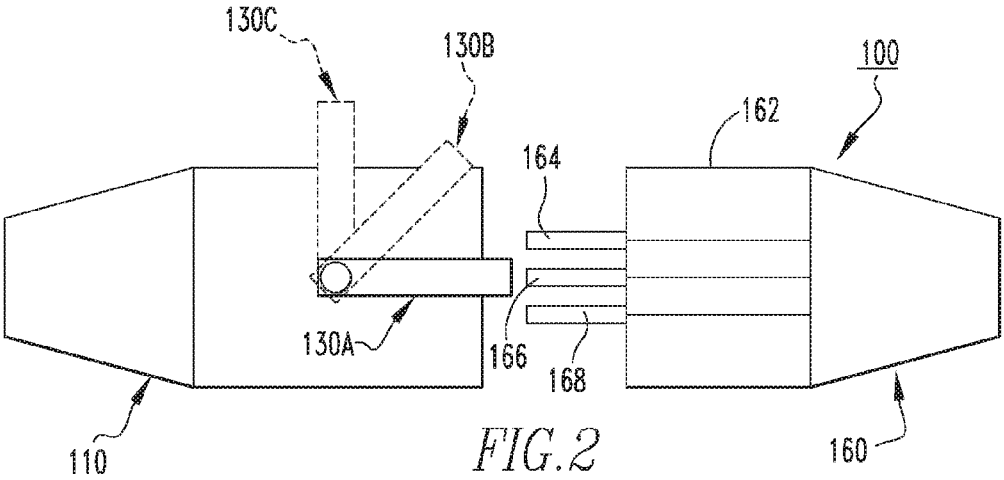
FIG. 2 is another simplified view of the power connector and electrical connection element therefor of FIG. 1, showing the operating lever in various positions in dashed line drawing.

FIG. 2 shows the power connector 100 in an alternative simplified view for ease of illustration. Specifically, FIG. 2 shows the manual operating lever 130 in a first position 130A (i.e., an ON position), a second position 130B (i.e., an OFF position) (shown in dashed line drawing), and a third position 130C (i.e., an EJECT position) (shown in dashed line drawing). When the pins 164,166,168 are mechanically coupled to the sleeves 114,116,118 (FIG. 1), and the manual operating lever 130 moves from the ON position 130A toward the OFF position 130B, the manual operating lever 130 opens the contact assembly 120 (FIG. 1) in order to disconnect power. When the manual operating lever 130 moves from the OFF position 130B toward the EJECT position 130C, the manual operating lever 130 may assist disengagement of the pins 164,166,168 and the sleeves 114,116,118 (FIG. 1). Similarly, when the manual operating lever 130 moves from the EJECT position 130C toward the OFF position 130B (i.e., when the contact assembly 120 is open and the pins 164,166,168 are not completely coupled to the sleeves 114,116,118), the manual operating lever 130 may assist engagement of the pins 164,166,168 and the sleeves 114,116,118. Finally, when the manual operating lever 130 moves from the OFF position 130B toward the ON position 130A (i.e., when the pins 164,166,168 are fully coupled to the sleeves 114,116,118), the manual operating lever 130 closes the contact assembly 120 (FIG. 1) in order to connect power.

Moreover, the operating mechanism of the line side electrical receptacle 110 provides an interlock that prevents engagement and disengagement of the pins 164,166,168 and the sleeves 114,116,118 when the manual operating lever 130 is in the ON position 130A. That is, when the contact assembly 120 is closed, the interlock of the manual operating lever 130 either ensures that the pins 164,166,168 and the sleeves 114,116,118 do not become disengaged (i.e., assuming the pins 164,166,168 and the sleeves 114,116,118 were engaged to begin with), or ensures that the pins 164,166,168 and the sleeves 114,116,118 do not become engaged (i.e., assuming the pins 164,166,168 and the sleeves 114,116,118 were disengaged to begin with). In one non-limiting embodiment, the interlock includes a pin or rim (not shown) with an expanded end. In this embodiment, the manual operating lever 130 includes a link member (not shown) that blocks the path for the respective pins 164,166,168 or rim (not shown) to prevent engagement when the manual operating lever 130 in the ON position 130A. Furthermore, in this embodiment the operating mechanism latches onto the expanded end and pulls the pins 164,166,168 and the sleeves 114,116,118 together to assist engagement when moving from the EJECT position 130C to the OFF position 130B. Additionally, the operating mechanism is maintained on the expanded end to prevent disengagement when the manual operating lever 130 is in the ON position 130A and pushes against the expanded end to assist disengagement when moving from the OFF position 130B to the EJECT position 130C.

Furthermore, the manual operating lever 130 advantageously opens and closes the contact assembly 120 by a snap-action mechanism. More specifically, in one non-limiting embodiment, the line side electrical receptacle 110 further includes a number of biasing elements (not shown) that cooperate with the manual operating lever 130 and the contact assembly 120 by releasing stored energy in order to allow the manual operating lever 130 to rapidly open and close the contact assembly 120.

Figure 3:
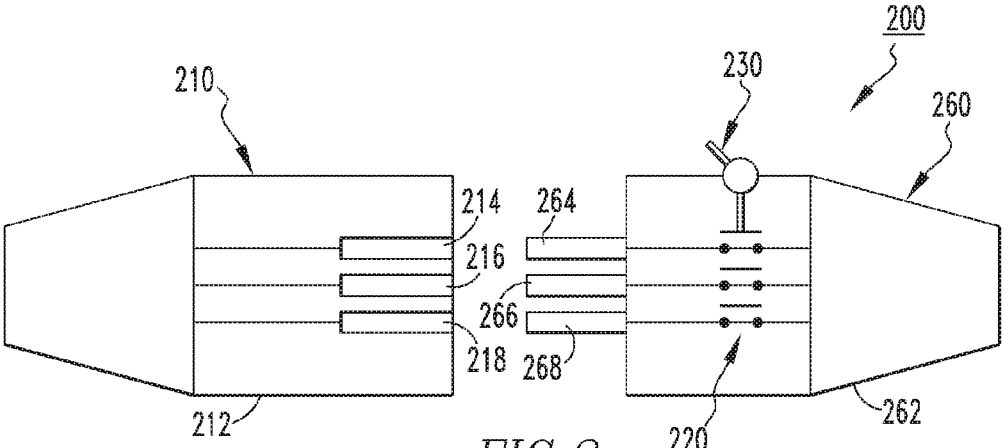
FIG. 3 is a simplified view of a power connector and electrical connection element therefor, in accordance with another non-limiting embodiment of the disclosed concept.

As seen in the non-limiting example of FIG. 3, the alternative power connector 200 includes many of the same components as the power connector 100 (FIGS. 1 and 2), and like components are labeled with like reference numerals. However, different from the power connector 100 (FIGS. 1 and 2), the load side electrical receptacle 260 includes the contact assembly 220 and the manual operating lever 230 for opening and closing the contact assembly 220. The contact assembly 220 is electrically connected to the pins 264,266,268 and has the same function as the contact assembly 120. Specifically, when the pins 264,266,268 are mechanically coupled to the sleeves 214,216,218, the contact assembly 220 is structured to electrically connect and disconnect power, advantageously allowing the location of the switching energy in the power connector 200 to be at the contact assembly 220, rather than at the connection between the pins 264,266,268 and the sleeves 214,216,218. It can thus be appreciated that advantages associated with employing the contact assembly 120 and the manual operating lever 130 in the line side electrical receptacle 110 for the power connector 100 likewise apply to employing the contact assembly 220 and the manual operating lever 230 in the load side receptacle 260 for the power connector 200.

Figure 4:
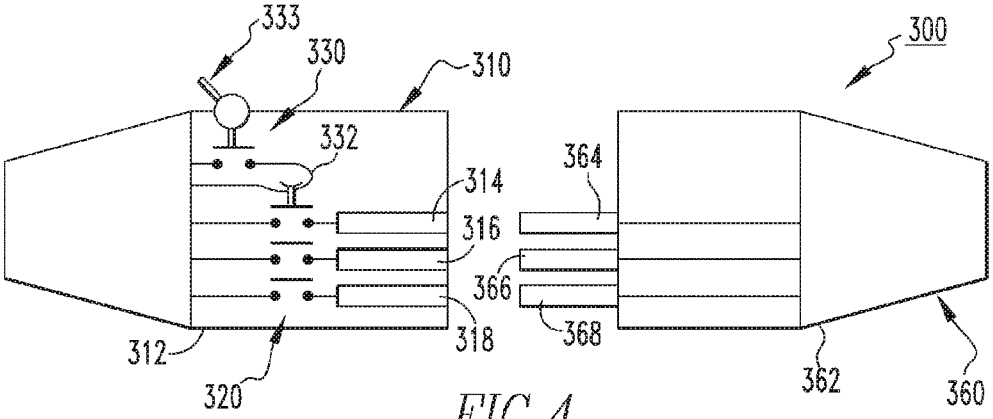
FIG. 4 is a simplified view of a power connector and electrical connection element therefor, in accordance with another non-limiting embodiment of the disclosed concept.

As seen in the non-limiting example of FIG. 4, the alternative power connector 300 includes many of the same components as the power connector 100 (FIGS. 1 and 2), and like components are labeled with like reference numerals. However, the line side electrical receptacle 310 includes an electromagnetic apparatus 330 as the operating mechanism for opening and closing the contact assembly 320 instead of the manual operating lever 130 (FIGS. 1 and 2). The electromagnetic apparatus 330 is coupled to the housing 312, and includes an electromagnet coil 332 and a manual coil power control switch 333. In operation, while the pins 364,366,368 are mechanically coupled to the sleeves 314,316,318, the manual coil power control switch 333 is structured to move between an ON position and an OFF position in order to connect power and disconnect power, respectively. When the manual coil power control switch 333 moves to the ON position, power from the line side electrical receptacle 310 is provided to the electromagnet coil 332, which advantageously allows the contact assembly 320 to rapidly close by a snap-action mechanism and thereby connect power. Similarly, when the manual coil power control switch 333 moves to the OFF position, power to the electromagnet coil 332 is turned off, thereby rapidly opening the contact assembly 320 by a snap-action mechanism and disconnecting power. It can thus be appreciated that advantages associated with employing the contact assemblies 120,220 and the manual operating levers 130,230 in the power connectors 100,200 likewise apply to employing the contact assembly 320 and the electromagnetic apparatus 330 in the power connector 300.

Figure 5:
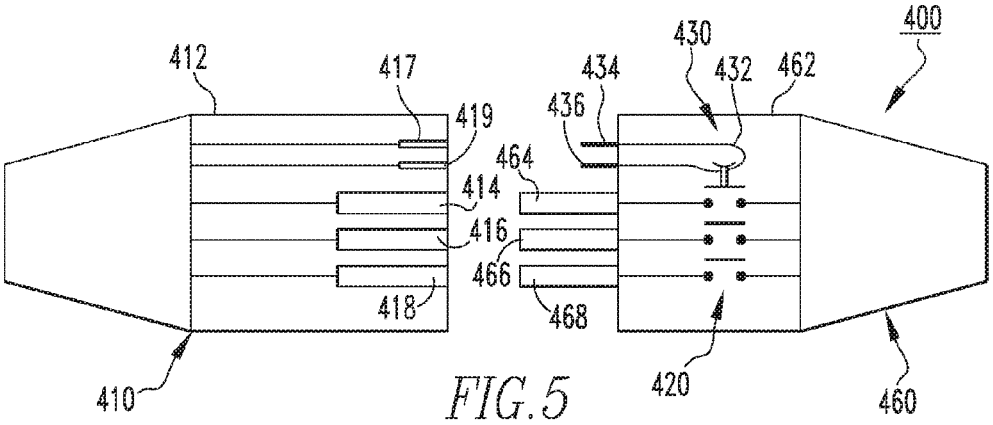
FIG. 5 is a simplified view of a power connector and electrical connection element therefor, in accordance with another non-limiting embodiment of the disclosed concept.

As seen in the non-limiting example of FIG. 5, the alternative power connector 400 includes many of the same components as the power connector 300 (FIG. 4), and like components are labeled with like reference numerals. However, the contact assembly 420 and an operating mechanism (e.g., without limitation, electromagnetic apparatus 430) for opening and closing the contact assembly 420 are located in the load side electrical receptacle 460. The electromagnetic apparatus 430 is coupled to the housing 462, and includes an electromagnetic coil 432 and a number of conductors (see, for example, two coil power pins 434,436) electrically connected to the electromagnetic coil 432. Furthermore, the housing 412 of the line side electrical receptacle 410 includes another number of conductors (see, for example two coil power sleeves 417,419). In operation, the pins 464,466,468 are first mechanically coupled to the sleeves 414,416,418. Next, the coil power pins 434,436 are engaged with (i.e., inserted into) the coil power sleeves 417,419 in order to provide power to the electromagnetic coil 432 to rapidly close the contact assembly 420 by a snap-action mechanism and thereby connect power. During disengagement, the coil power pins 434,436 are disengaged first from the coil power sleeves 417,419, thereby removing power from the electromagnetic coil 432 and rapidly opening the contact assembly 420 by a snap-action mechanism, while the pins 464,466,468 remain mechanically coupled to the sleeves 414,416,418.

It will be appreciated with reference to FIG. 5 that the pins 464,466,468 are structured to extend a greater distance into the housing 412 of the line side electrical receptacle 410 than the coil power pins 434,436, thereby allowing the pins 464,466,468 and the sleeves 414,416,418 to engage before the contact assembly 420 is closed, and disengage after the contact assembly 420 is opened. As a result, any electrical switching within the power connector 400 (i.e., when power is connected and when power is disconnected) occurs while the pins 464,466,468 and the sleeves 414,416,418 are mechanically coupled. Thus, advantages with respect to minimizing "hot plugging" likewise apply to the power connector 400.

Figure 6:
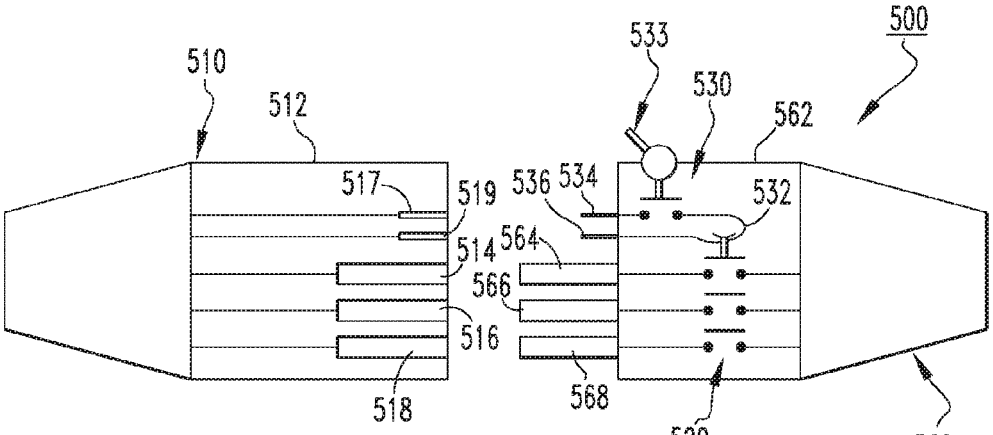
FIG. 6 is a simplified view of a power connector and electrical connection element therefor, in accordance with another non-limiting embodiment of the disclosed concept.

As seen in the non-limiting example of FIG. 6, the alternative power connector 500 includes many of the same components as the power connector 400 (FIG. 5), and like components are labeled with like reference numerals. However, the electromagnetic apparatus 530, which is coupled to the housing 562, includes a manual coil power control switch 533 that turns power to the electromagnetic coil 532 on and off. Specifically, when the pins 564,566,568 are mechanically coupled to the sleeves 514,516,518, and the coil power pins 534,536 are mechanically connected to (i.e., inserted into) the coil power sleeves 517,519, the manual coil power control switch 533 can either connect power by rapidly closing the contact assembly 520 by a snap-action mechanism, or disconnect power by rapidly opening the contact assembly 520 by a snap-action mechanism. Similar to the power connector 400, the pins 564,566,568 are structured to extend a greater distance into the line side electrical receptacle 510 than the coil power pins 534,536, thereby allowing the pins 564,566,568 and the sleeves 514,516,518 to engage before the contact assembly 520 is closed, and disengage after the contact assembly 520 is opened.

Figure 7:
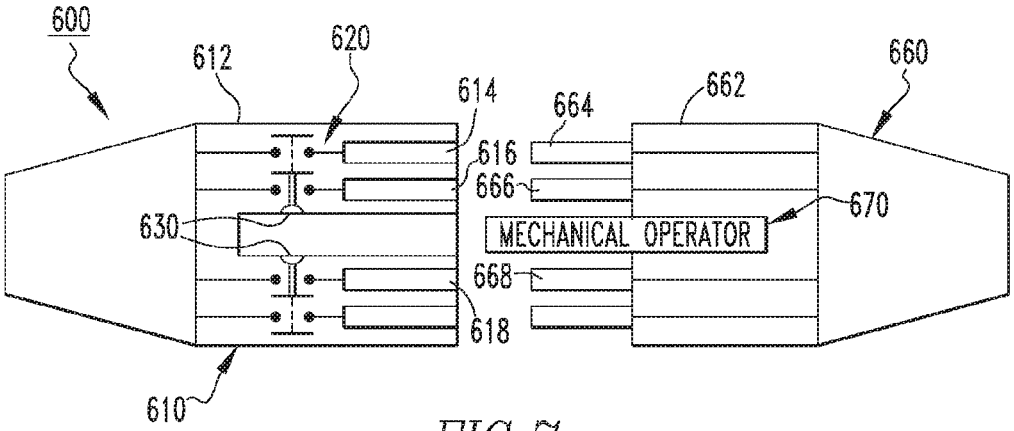
FIG. 7 is a simplified view of a power connector and electrical connection element therefor, in accordance with another non-limiting embodiment of the disclosed concept.

As seen in the non-limiting example of FIG. 7, the alternative power connector 600 includes many of the same components as the power connector 100 (FIGS. 1 and 2), and like components are labeled with like reference numerals. However, the operating mechanism 630 for opening and closing the contact assembly 620 is different. Additionally, the housing 662 further includes a driving member (e.g., without limitation, mechanical operator 670) that cooperates with the operating mechanism 630 to open and close the contact assembly 620.

Figure 8A:
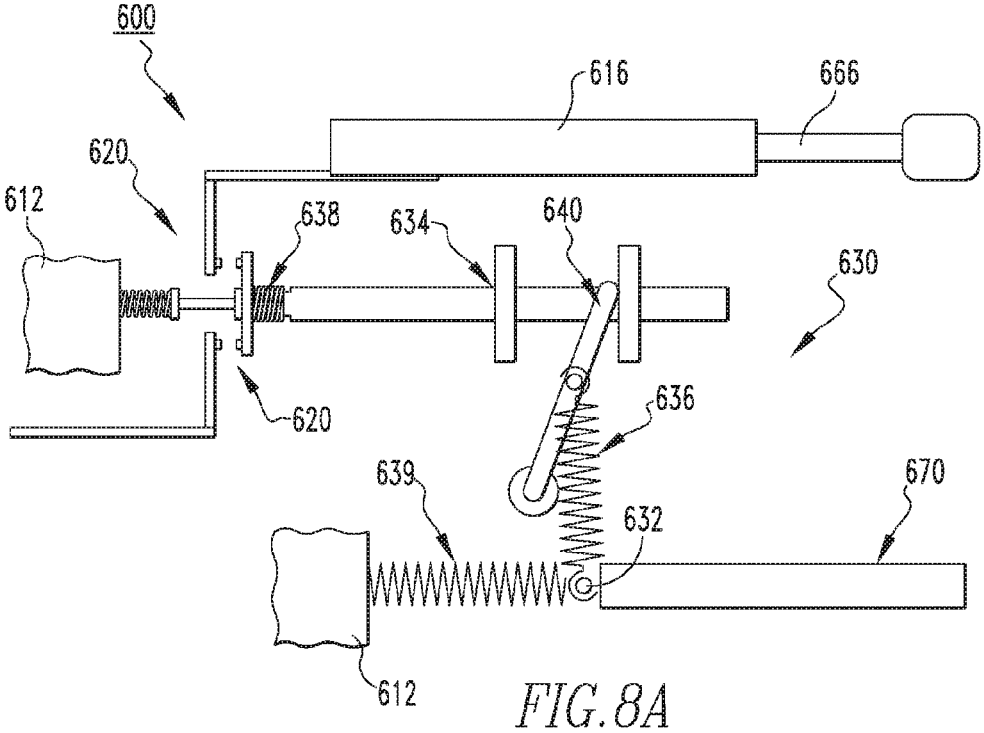
FIG. 8A is a simplified view of a portion of the power connector and electrical connection element therefor of FIG. 7, showing the operating mechanism in a position corresponding to the contact assembly being open.
Figure 8B:
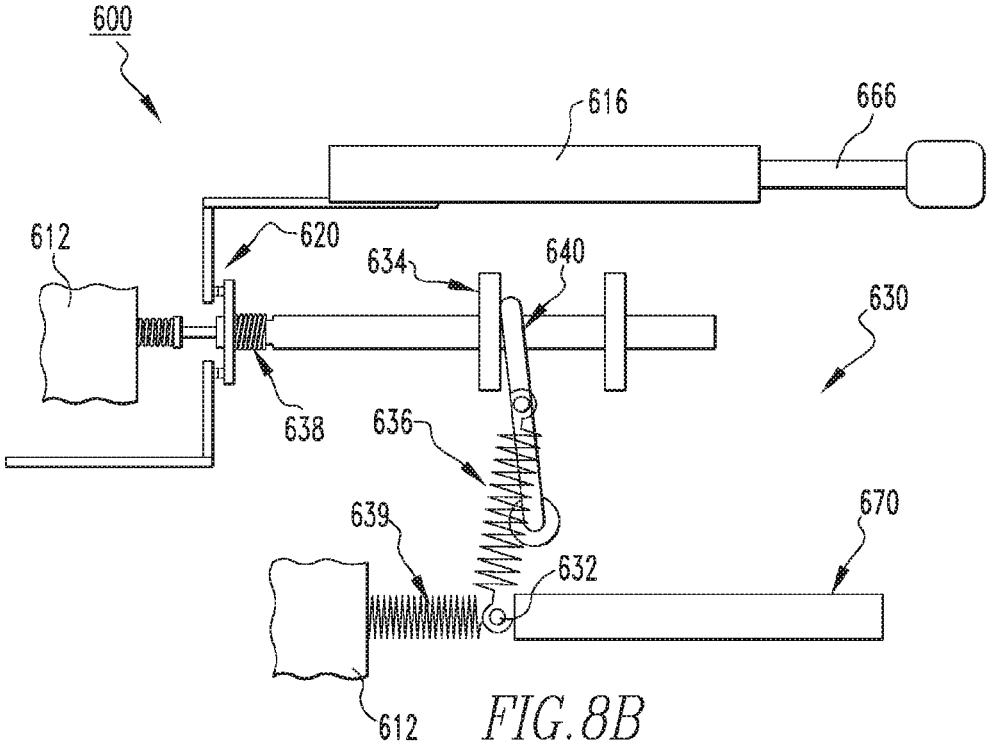
FIG. 8B is another simplified view of the portion of the power connector and electrical connection element therefor of FIG. 8A, showing the operating mechanism in a position corresponding to the contact assembly being closed.

Referring to the non-limiting example of FIGS. 8A and 8B, a portion of the power connector 600 is shown in an alternative simplified view for ease of illustration. As shown, the operating mechanism 630 includes a first sliding member 632, a second sliding member 634, a first biasing element (e.g., without limitation, spring 636), a second biasing element (e.g., without limitation, spring 638), a third biasing element (e.g., without limitation, spring 639), and a linking member 640 each coupled to the housing 612. As shown, the spring 636 couples the first sliding member 632 to the linking member 640. The spring 638 couples the second sliding member 634 to the contact assembly 620. FIG. 8A shows the operating mechanism 630 in a first position corresponding to the contact assembly 620 being open. FIG. 8B shows the operating mechanism 630 in a second position corresponding to the contact assembly 620 being closed.

The operating mechanism 630 moves from the first position (FIG. 8A) to the second position (FIG. 8B) as a result of the mechanical operator 670. More specifically, when the pins 664,666,668 are mechanically coupled to (i.e., inserted into) the sleeves 614,616,618 (see, for example, the pin 666 inserted into the sleeve 616 in FIGS. 8A and 8B), and the line side electrical receptacle 610 and the load side electrical receptacle 660 are pushed closer together, the mechanical operator 670 pushes the first sliding member 632 from the first position (FIG. 8A) toward the second position (FIG. 8B). Similarly, responsive to the first sliding member 632 moving from the first position (FIG. 8A) toward the second position (FIG. 8B), the spring 636 pulls the linking member 640 from the first position (FIG. 8A) toward the second position (FIG. 8B). When the linking member 640 moves from the first position (FIG. 8A) toward the second position (FIG. 8B), the linking member 640 drives the second sliding member 634, thereby causing the spring 638 to close the contact assembly 620.

When the mechanical operator 670 moves from the second position (FIG. 8B) toward the first position (i.e., when the line side electrical receptacle 610 and the load side electrical receptacle 660 begin to move away from each other, but the pins 664,666,668 remain mechanically coupled to (i.e., inserted into) the sleeves 614,616,618), the spring 639 pushes the first sliding member 632 toward the first position (FIG. 8A), and the spring 636 pulls the linking member 640 away from the contact assembly 620 in order to drive the second sliding member 634 toward the first position (FIG. 8A). When the second sliding member 634 moves from the second position (FIG. 8B) toward the first position (FIG. 8A), the spring 638 opens the contact assembly 620. Thus because the pins 664,666,668 remain mechanically coupled to (i.e., inserted into) the sleeves 614,616,618 when the contact assembly 620 opens and closes, switching energies are advantageously focused on the contact assembly 620, resulting in the improvements with respect to "hot plugging," described hereinabove.

Figure 9:
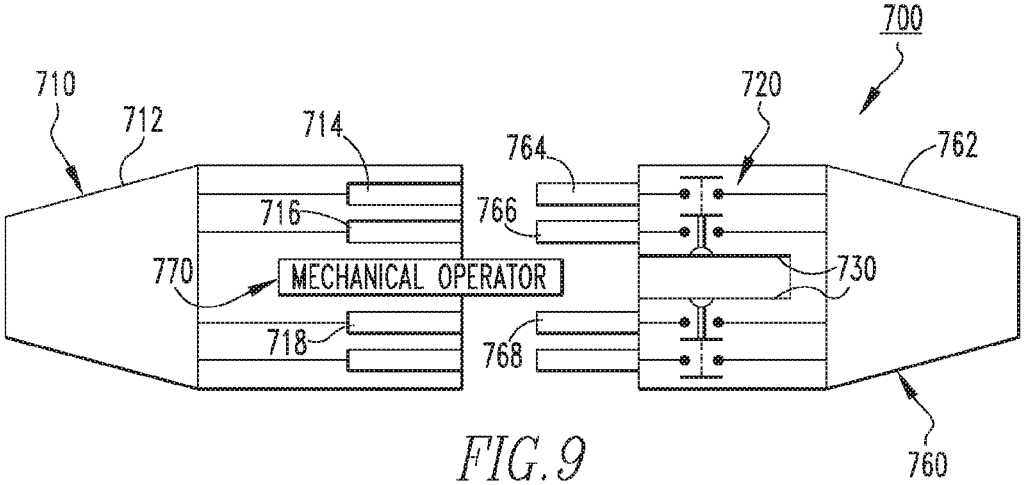
FIG. 9 is a simplified view of a power connector and electrical connection element therefor, in accordance with another non-limiting embodiment of the disclosed concept.

As seen in the non-limiting example of FIG. 9, the alternative power connector 700 includes many of the same components as the power connector 600 (FIGS. 7, 8A, and 8B), and like components are labeled with like reference numerals. However, different from the power connector 600 (FIGS. 7, 8A, and 8B), the housing 712 of the line side electrical receptacle 710 includes the mechanical operator 770, and the load side electrical receptacle 760 includes the contact assembly 720 and the operating mechanism 730. It will be appreciated that the mechanical operator 770 cooperates with the operating mechanism 730 to open and close the contact assembly 720 in substantially the same manner in which the mechanical operator 670 (FIGS. 7, 8A, and 8B) cooperates with the operating mechanism 630 (FIGS. 7, 8A, and 8B) to open and close the contact assembly 620. Thus, advantages of the power connector 600 (FIGS. 7, 8A, and 8B) associated with improvements in terms of "hot plugging" likewise apply to the power connector 700.

Figure 10:
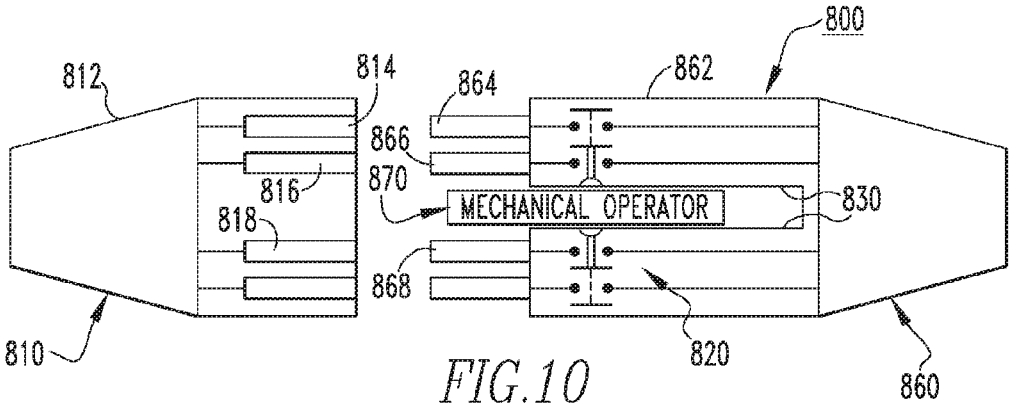
FIG. 10 is a simplified view of a power connector and electrical connection element therefor, in accordance with another non-limiting embodiment of the disclosed concept.

As seen in the non-limiting example of FIG. 10, the alternative power connector 800 includes many of the same components as the power connectors 600,700 (FIGS. 7-9), and like components are labeled with like reference numerals. However, different from the power connectors 600,700 (FIGS. 7-9), the mechanical operator 870 of the power connector 800 is movably coupled to the operating mechanism 830 of the load side electrical receptacle 860. That is, the mechanical operator 870 and the operating mechanism 830 are each components of the same receptacle (i.e., the load side electrical receptacle 860). It will be appreciated that the mechanical operator 870 cooperates with the operating mechanism 830 in substantially the same manner as the mechanical operators 670,770 and the operating mechanisms 630,730, described hereinabove. However, unlike the power connectors 600,700, the mechanical operator 870 is driven into the operating mechanism 830 by the housing 812 of the opposing receptacle (i.e., the line side electrical receptacle 810).

Furthermore, it will be appreciated that the pins 864,866, 868 extend a greater distance away from the contact assembly 820 than the mechanical operator 870. Thus, as the line side electrical receptacle 810 is mechanically coupled to the load side electrical receptacle 860, the pins 864,866,868 will extend into and remain mechanically coupled to the respective sleeves 814,816,818 before the mechanical operator 870 engages the housing 812 of the line side electrical receptacle 810 (i.e., in order to connect power). Similarly, when the line side electrical receptacle 810 is disconnected from the load side electrical receptacle 860, the pins 864,866,868 will remain mechanically coupled to the respective sleeves 814, 816,818 when the mechanical operator 870 disengages the housing 812 of the line side electrical receptacle 810 (i.e., and thus disconnects power). Furthermore, it will be appreciated that the power connector 800 advantageously employs a known receptacle (i.e., the line side electrical receptacle 810) that requires no modification. Thus, manufacturing of the power connector 800 is simplified as a known line side electrical receptacle 810 is able to be employed.

Figure 11A:
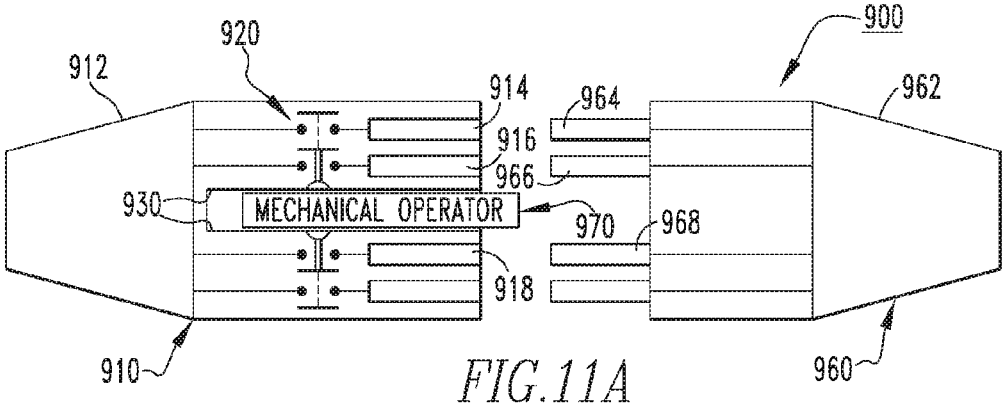
FIG. 11A is a simplified view of a power connector and electrical connection element therefor, in accordance with another non-limiting embodiment of the disclosed concept.
Figure 11B:
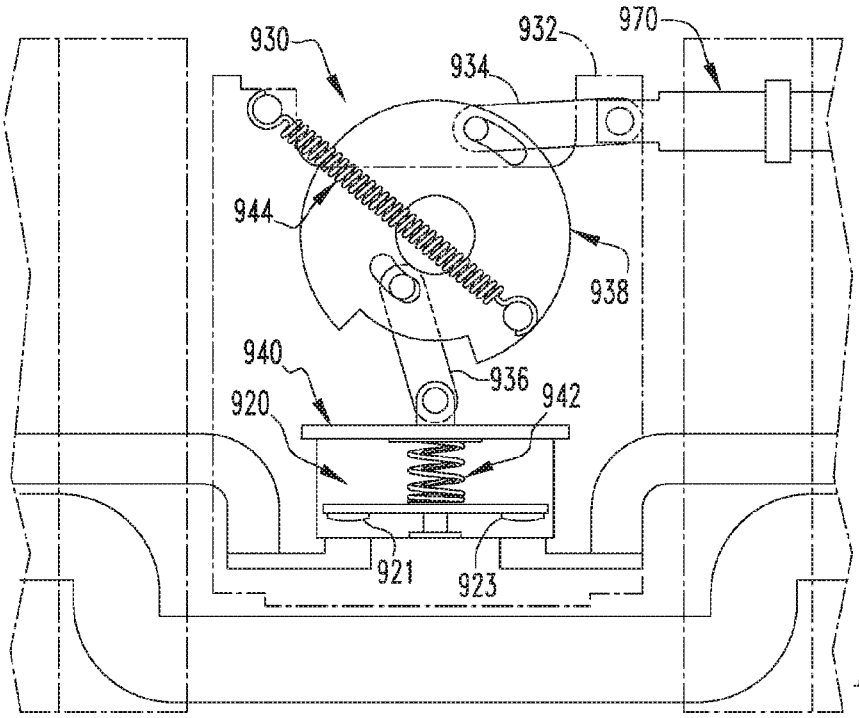
FIG. 11B is a schematic view of a portion of the electrical connection element of FIG. 11A, shown with portions removed in order to see hidden structures.

As seen in the non-limiting example of FIG. 11A, the alternative power connector 900 includes many of the same components as the power connector 800 (FIG. 10), and like components are labeled with like reference numerals. However, different from the power connector 800 (FIG. 10), the line side electrical receptacle 910 of the power connector 900 includes the operating mechanism 930 and the mechanical operator 970. The mechanical operator 970 is caused to cooperate with the operating mechanism 930 by the housing 962 of the load side electrical receptacle 960 (i.e., is driven inwardly with respect to the housing 912 by the housing 962). FIG. 11B shows one non-limiting example embodiment, shown schematically, of the mechanical operator 970 and the operating mechanism 930 of FIG. 11A. The operating mechanism 930 includes a housing 932 (shown in simplified form in phantom line drawing), a first link member 934, a second link member 936, a cam 938, a contact carrier 940, a first biasing element (e.g., contact spring 942), and a second biasing element (e.g., cam spring 944). The housing 932 is coupled to the housing 912 by any suitable mechanism. The first link member 934 couples the mechanical operator 970 to the cam 938. The second link member 936 couples the cam 938 to the contact carrier 940. The contact spring 942 is coupled to the contact carrier 940 and a pair of electrical contacts 921,923 of the contact assembly 920. The cam spring 944 is coupled to the housing 932 and the cam 938. The link members 934,936, the cam 938, the contact carrier 940, and the springs 942,944 cooperate with one another and with the mechanical operator 970 in order to open and close the contact assembly 920.

That is, the first link member 934, the second link member 936, the cam 938, the contact spring 942, the cam spring 944, and the contact carrier 940 are structured to move between a first position (shown in FIG. 11B) corresponding to the contact assembly 920 being open and a second position (not shown) corresponding to the contact assembly being closed. The mechanical operator 970 is structured to drive the first link member 934 from the first position to the second position. The first link member 934 and the cam spring 944 are structured to drive the cam 938 from the first position to the second position. Responsive to the cam 938 moving from the first position to the second position, the second link member 936 drives the contact carrier 940, thereby causing the contact spring 942 to close the contact assembly 920 by a mechanism with a snap-action motion.

Stated differently, responsive to movement of the mechanical operator 970 (i.e., in the depicted orientation the movement is to the left and is caused by the housing 962), the first link member 934 drives the cam 938, causing the cam 938 to rotate. After the cam 938 rotates a predetermined distance (i.e., the rotational distance which places the cam spring 944 in maximum tension), the cam spring 944 rapidly releases energy and continues to rotate the cam 938 in the same direction of rotation. When the cam spring 944 begins to release energy to drive the cam 938, the second link member 936 rapidly drives the contact carrier 940 (i.e., in the depicted orientation this is in the downward direction) in order to close the contact assembly 920. It will however be appreciated that the operating mechanism 930 may be replaced with a suitable alternative operating mechanism, such as the operating mechanism 630, discussed hereinabove. It will also be appreciated that the power connector 900 operates in a similar manner (i.e., pins 964,966,968 remaining mechanically coupled to sleeves 914,916,918 while mechanical operator 970 and housing 962 cause power to connect and disconnect) as the power connector 800 (FIG. 10). Furthermore, the power connector 900 advantageously employs a known receptacle (i.e., load side electrical receptacle 960) which requires no modification, thereby simplifying manufacturing. Additionally, the operating mechanism 830 (FIG. 10) of the power connector 800 (FIG. 10) may be replaced with the operating mechanism 930 and cooperate with the mechanical operator 870 in substantially the same manner as the operating mechanism 930 and the mechanical operator 970 cooperate with one another.

Figure 12:
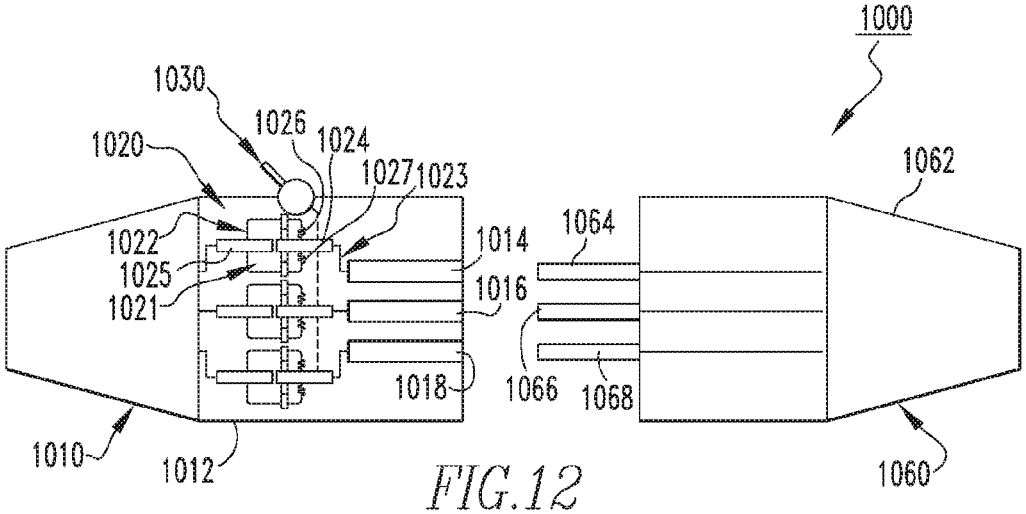
FIG. 12 is a simplified view of a power connector and electrical connection element therefor, in accordance with another non-limiting embodiment of the disclosed concept.

As seen in the non-limiting example of FIG. 12, the alternative power connector 1000 includes many of the same components as the power connector 100 (FIGS. 1 and 2), and like components are labeled with like reference numerals. However, the contact assembly 1020 of the line side electrical receptacle 1010 includes a number of sets of separable contacts 1021, a corresponding number of vacuum bottles 1022, and a corresponding number of flexible conductors 1023. For ease of illustration and economy of disclosure only the set of separable contacts 1021, the vacuum bottle 1022, and the flexible conductor 1023 will be described in detail, although it will be appreciated that the other sets of separable contacts, vacuum bottles, and flexible conductors shown are configured in substantially the same manner. The set of separable contacts 1021 includes a first contact 1024 and a second contact 1025. In operation, when the first contact 1024 engages the second contact 1025, an electrical pathway is created therebetween. However, the first contact 1024 is structured to move into and out of engagement with the second contact 1025 in order to open and close the contact assembly 1020.

More specifically, the operating mechanism is an operating lever 1030 that is coupled to each respective first contact 1024 and causes the respective first contacts 1024 to move into and out of engagement with the respective second contacts 1025. Additionally, the vacuum bottle 1022 and the flexible conductor 1023 advantageously allow the first contact 1024 to move into and out of engagement with the second contact 1025. The vacuum bottle 1022 includes a number of convolutions 1026,1027 that are coupled to the first contact 1024. The convolutions 1026,1027 allow the vacuum bottle 1022 to flex and move with the first contact 1024 in response to movement of the operating lever 1030, thus allowing the first contact 1024 and the second contact 1025 to open and close within the vacuum bottle 1022. Furthermore, the flexible conductor 1023 is mechanically coupled to and electrically connected in series in between the first contact 1024 and the sleeve 1014 in order to allow movement of the first contact 1024. As such, when the first contact 1024 moves, a mechanical and electrical connection is advantageously maintained between the first contact 1024 and the sleeve 1014. Thus, it will be appreciated that in addition to advantages associated with minimizing "hot plugging" in the power connector 1000 by employing the contact assembly 1020 and the operating lever 1030, the power connector 1000 has the significant additional advantage of achieving arc free operation by containing any electrical arcing within the vacuum bottles 1022. As a result, oil, gas, and mining industries that employ the power connector 1000 are significantly safer, as interaction with a potential arc and explosive materials is significantly minimized.

Figure 13:
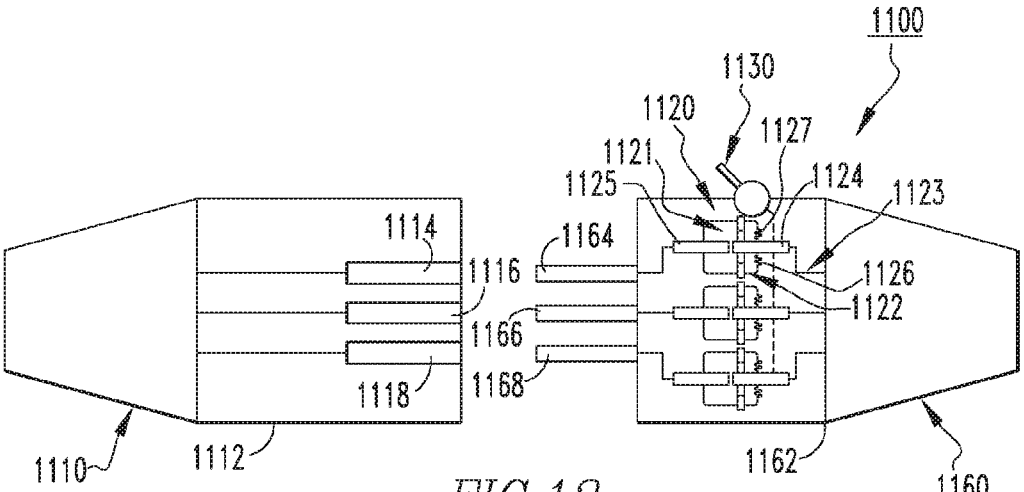
FIG. 13 is a simplified view of a power connector and electrical connection element therefor, in accordance with another non-limiting embodiment of the disclosed concept.

As seen in the non-limiting example of FIG. 13, the alternative power connector 1100 includes many of the same components as the power connector 1000 (FIG. 12), and like components are labeled with like reference numerals. However, the contact assembly 1120 and the operating lever 1130 are components of the load side electrical receptacle 1160 and not the line side electrical receptacle 1110. The operating lever 1130 moves the first contact 1124 into and out of engagement with the second contact 1125 within the vacuum bottle 1122 in substantially the same manner as the operating lever 1030 (FIG. 12). Thus, it will be appreciated that advantages associated with minimizing "hot plugging" and achieving arc free operation because of the vacuum bottles likewise applies to the power connector 1100.

Figure 14:
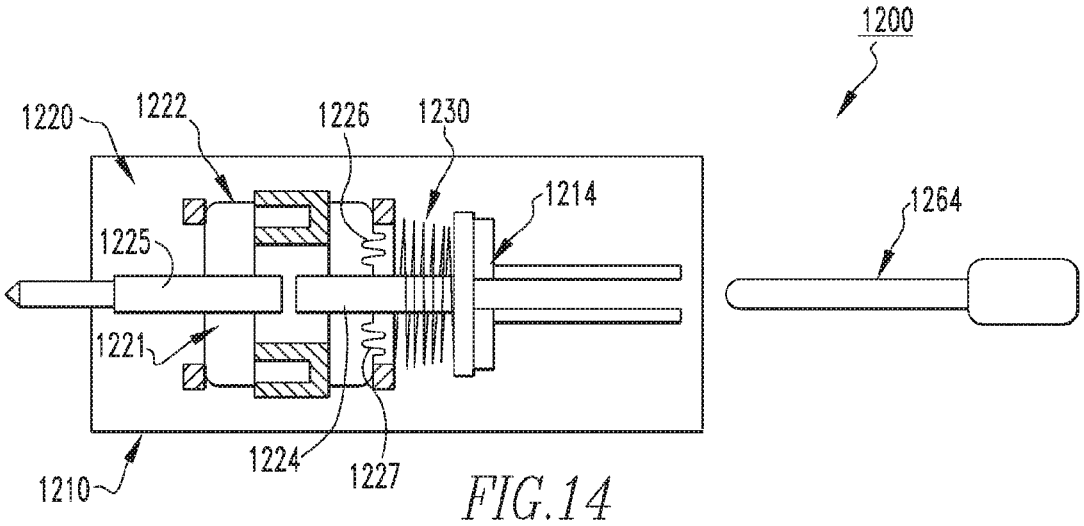
FIG. 14 is a simplified view of a portion of a power connector and electrical connection element therefor, in accordance with another non-limiting embodiment of the disclosed concept.

As seen in the non-limiting example of FIG. 14, the alternative portion of the power connector 1200 includes many of the same components as the power connectors 1000,1100 (FIGS. 12 and 13), and like components are labeled with like reference numerals. However, the operating mechanism of the power connector 1200 includes a biasing element (e.g., spring 1230) that is coupled to the first contact 1224 and the sleeve 1214. In operation, when the pin 1264 is inserted into the sleeve 1214 and is fully engaged (i.e., is entirely inserted into and/or cannot be pushed into the sleeve 1214 anymore), the sleeve 1214 is structured to slide within the line side electrical receptacle 1210 (partially shown) and cause the spring 1230 to move the first contact 1224 into engagement with the second contact 1225. That is, the sleeve 1214 moves independently with respect to the second contact 1225 in order to allow the spring 1230 to close the contacts 1224,1225. Similarly, when the pin 1264 is pulled away from the sleeve 1214, the spring 1230 pulls the first contact 1224 out of engagement with the second contact 1225, thereby disconnecting power. Because the pin 1264 and the sleeve 1214 remain mechanically coupled when the contact assembly 1220 is opened (and also remain coupled when the contact assembly 1220 is closed), advantages associated with minimizing "hot plugging" likewise apply to the power connector 1200. Similarly, because the first contact 1224 and the second contact 1225 open and close within the vacuum bottle 1222, beneficial arc free operation is likewise achieved in the power connector 1200.

Figure 15:
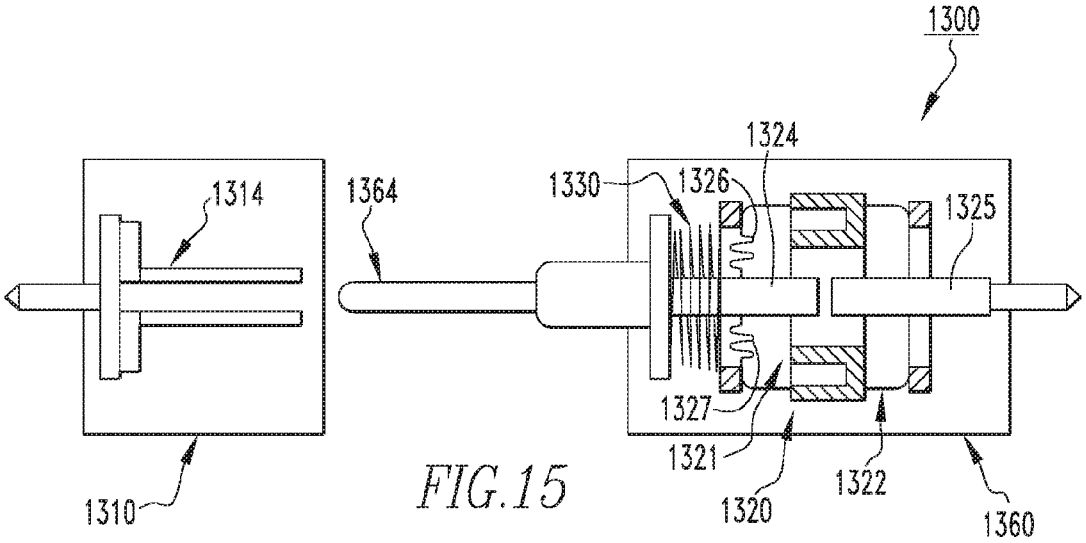
FIG. 15 is a simplified view of a portion of a power connector and electrical connection element therefor, in accordance with another non-limiting embodiment of the disclosed concept.

As seen in the non-limiting example of FIG. 15, the alternative power connector 1300 includes many of the same components as the power connector 1200 (FIG. 14), and like components are labeled with like reference numerals. However, the load side electrical receptacle 1360 includes the contact assembly 1320 and the spring 1330. Thus, it will be appreciated that the pin 1364 is structured to slide within the load side electrical receptacle 1360 and move independently with respect to the second contact 1325. That is, when the pin 1364 is fully engaged (i.e., cannot be inserted further into) with the sleeve 1314, the sleeve 1314 pushes the pin 1364, and thus the spring 1330 is able to move the first contact 1324 into engagement with the second contact 1325 to connect power. Accordingly, advantages associated with "hot plugging" and achieving arc free operation likewise apply to the power connector 1300.

Figure 16:
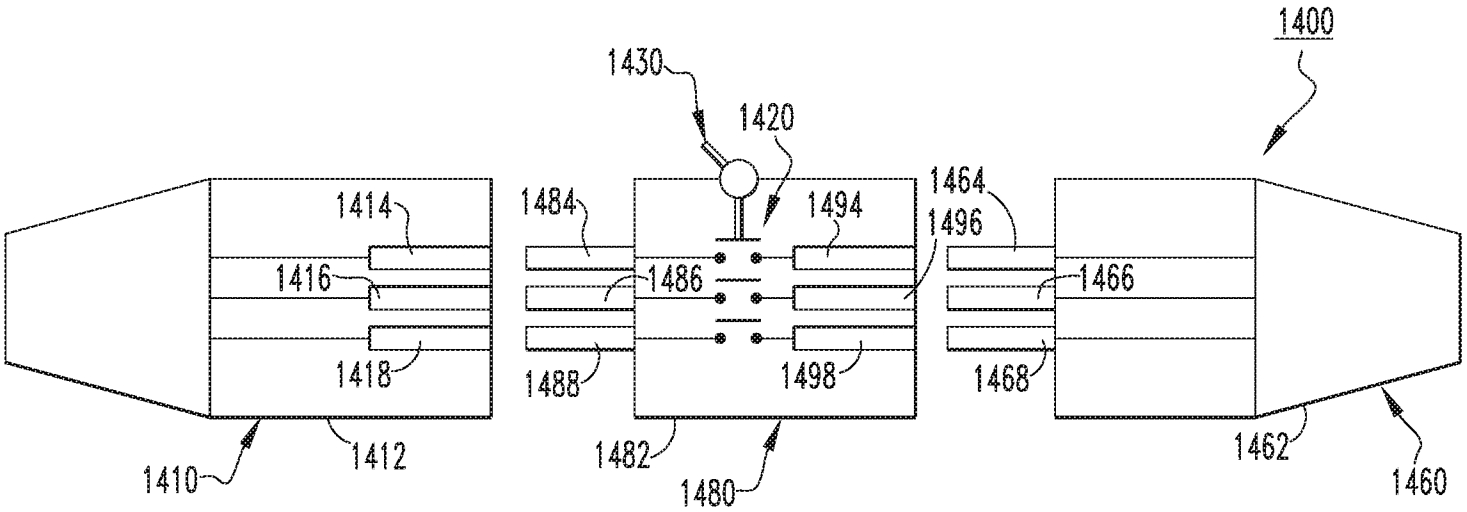
FIG. 16 is a simplified view of a power connector and electrical connection element therefor, in accordance with another non-limiting embodiment of the disclosed concept.

As seen in the non-limiting example of FIG. 16, the alternative power connector 1400 includes many of the same components as the power connector 100 (FIGS. 1 and 2), and like components are labeled with like reference numerals. However, different from the power connector 100 (FIGS. 1 and 2), the power connector 1400 further includes an electrical connection element (e.g., without limitation, adapter 1480) that mechanically couples and electrically connects the line side electrical receptacle 1410 to the load side electrical receptacle 1460. The adapter 1480 includes a housing 1482 that has a first number of electrical mating members, such as the example male conductors (e.g., without limitation, pins 1484,1486,1488) and a second number of electrical mating members, such as the example female conductors (e.g., without limitation, sleeves 1494,1496, 1498).

Additionally, as shown, the adapter 1480 advantageously includes the contact assembly 1420 and the operating lever 1430 that opens and closes the contact assembly 1420. In operation, the pins 1484,1486,1488 remain mechanically coupled to (i.e., inserted into) and electrically connected with the sleeves 1414,1416,1418, and the pins 1464,1466, 1468 remain mechanically coupled to (i.e., inserted into) and electrically connected with the sleeves 1494,1496,1498 when the operating lever 1430 opens and closes the contact assembly 1420. Thus, advantages associated with minimizing "hot plugging" are likewise provided for in the power connector 1400. Additionally, the adapter 1480 is a separate component from the line side electrical receptacle 1410 and the load side electrical receptacle 1460. It will be appreciated that the power connector 1400 advantageously employs known receptacles (i.e., the line side electrical receptacle 1410 and the load side electrical receptacle 1460) that advantageously require no modification. Thus, manufacturing of the power connector 1400 is advantageously simplified and "hot plugging" is minimized.

Accordingly, it will be appreciated that the disclosed concept provides for an improved (e.g., without limitation, longer-lasting, better-protected from dangerous switching energies) power connector 100,200,300,400,500,600,700, 800,900,1000,1100,1200,1300,1400 and electrical connection element 110,260,310,460,560,610,760,860,910,1010, 1160,1210,1360, 1480 and associated method therefor, which among other benefits, redirects switching energy to a contact assembly 120,220,320,420,520,620,720,820,920, 1020,1120,1220,1320,1420 in order to minimize the occurrence of "hot plugging" within the power connector 100, 200,300,400,500, 600,700,800,900,1000,1100,1200,1300, 1400.

Figure 17:
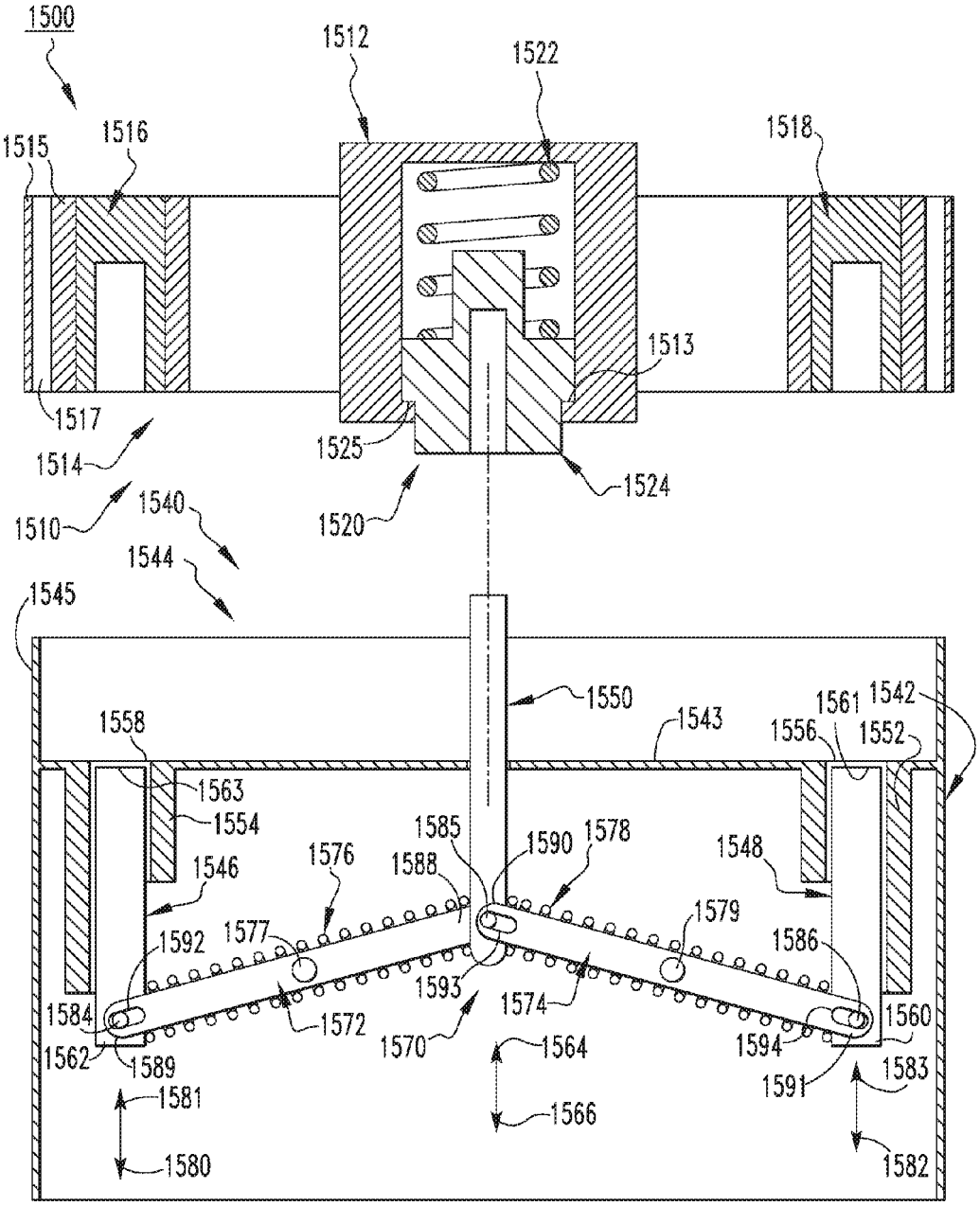
FIG. 17 is a simplified view of a power connector and electrical connection element therefor, showing the second mating assembly in a first position, in accordance with another non-limiting embodiment of the disclosed concept.

In addition to the foregoing, FIG. 17 shows a simplified view of a portion of a non-limiting example power connector 1500 in which an electrical connection element (e.g., load side electrical receptacle 1540) includes an insulative housing 1542 and a mating assembly 1544 located on the insulative housing 1542. In the example shown, the line side electrical receptacle 1510 includes an insulative housing 1512 and a mating assembly 1514 located on the insulative housing 1512. As shown, the mating assembly 1514 includes a number of electrical mating members such as the example female conductors (e.g., phase sleeves 1516,1518) that are substantially enclosed by the insulative housing 1512.

The mating assembly 1544 includes a number of electrical mating members such as the example male conductors (e.g., phase pins 1546,1548) that are structured to be electrically connected to the sleeves 1516,1518. In the depicted first position of FIG. 17, the load side electrical receptacle 1540 is spaced from the line side electrical receptacle 1510. In this position, and as will be discussed in greater detail below, the pins 1546,1548 are advantageously substantially enclosed by the insulative housing 1542. Thus, the potential for inadvertent contact with the potentially "hot" pins 1546, 1548 is significantly lessened, as the pins 1546,1548 are well protected (i.e., as a result of being surrounded by or enclosed by the insulative housing 1542) in this position. Also, the power connector 1500 advantageously allows the pins 1546, 1548 to move to a second position (shown in FIG. 20) in which the pins 1546,1548 engage the sleeves 1516,1518 in order to create an electrical pathway therebetween and thus connect power. That is, the mating assembly 1544 is structured to move between a first position (FIG. 17) corresponding to the pins 1546,1548 being substantially enclosed by the insulative housing 1542, and a second position (FIG. 20) corresponding to the pins 1546,1548 being partially located external the insulative housing 1542.

Continuing to refer to FIG. 17, the mating assembly 1514 of the line side electrical receptacle 1510 further includes a driving apparatus 1520 coupled to the insulative housing 1512. The driving apparatus 1520 has a biasing element (e.g., spring 1522) and a ground sleeve 1524. The ground sleeve 1524 is slidably coupled to the insulative housing 1512. Specifically, in operation the ground sleeve 1524 is structured to move independently with respect to the insulative housing 1512. Additionally, the insulative housing 1512 has a shelf 1513 and the ground sleeve 1524 has a lip 1525 that is structured to engage the shelf 1513. The interaction between the lip 1525 of the ground sleeve 1524 and the shelf 1513 advantageously allows the ground sleeved to be maintained on the insulative housing 1512.

The spring 1522 engages the insulative housing 1512 and biases the ground sleeve 1524 in a direction 1566. The mating assembly 1544 of the load side electrical receptacle 1540 further includes a driving apparatus (e.g., ground pin 1550) that is structured to move in a first direction 1564 and a second direction (i.e., the direction 1566) opposite the first direction 1564. In operation, and as will be discussed in greater detail hereinbelow, the ground pin 1550 cooperates with the driving apparatus 1520 of the line side electrical receptacle 1510 in order to move the mating assembly 1544 between the first position (FIG. 17) corresponding to the pins 1546,1548 being substantially enclosed by the insulative housing 1542, and the second position (FIG. 20) corresponding to the pins 1546,1548 being partially located external the insulative housing 1542.

More specifically, the insulative housing 1542 has a generally planar insulative panel 1543, an annular-shaped peripheral rim 1545, and a number of insulative receiving portions (see, for example, two insulative receiving portions 1552,1554). The insulative panel 1543 is located generally internal the peripheral rim 1545 (see, for example, FIG. 18). The peripheral rim 1545 cooperates with the insulative housing 1512 of the line side electrical receptacle 1510 to insulate the pins 1546,1548, as will be discussed in greater detail below. The receiving portions 1552,1554 each extend from the panel 1543 toward a respective end portion 1560, 1562 of the pins 1546,1548. The receiving portions 1552, 1554 have respective distal portions 1556,1558 located at the insulative panel 1543. The pins 1546,1548 have respective first end portions (i.e., the end portions 1560,1562) and respective second end portions 1561,1563 located opposite and distal the respective first end portions 1560,1562.

As shown, when the mating assembly 1544 is in the first position (FIG. 17), the second end portions 1561,1563 are located between the respective distal portions 1556,1558 and the respective first end portions 1560,1562. Although it is within the scope of the disclosed concept for the second end portions 1561,1563 to be located at the insulative panel 1543 when the mating assembly 1544 is in the first position (FIG. 17), having the second end portions 1561,1563 spaced a distance internal from the insulative panel 1543 provides advantageous additional protection. Thus, in the depicted first position of FIG. 17 (i.e., the position of the power connector 1500 when the line side electrical receptacle 1510 and the load side electrical receptacle 1540 are spaced apart and not engaging one another), the respective second end portions 1561,1563 are substantially enclosed by (i.e., surrounded by and/or do not extend external to) the insulative housing 1542. It will thus be appreciated that the panel 1543 and the receiving portions 1552,1554 advantageously provide a protective insulative barrier between an operator and the potentially "hot" pins 1546,1548. This is distinct from known power connectors (not shown) in which the pins (not shown) are undesirably exposed and pose danger to operators when they are "hot." Accordingly, when the load side electrical receptacle 1540 is disconnected from (i.e., separated from and not engaging) the line side electrical receptacle 1510, operators are well protected against risks of inadvertent and dangerous contact with the potentially "hot" pins 1546,1548.

Additionally, the power connector 1500 provides for a snap-action engagement between the pins 1546,1548 and the sleeves 1516,1518, which advantageously minimizes electrical arcing, heat dissipation, and teasing, therefore improving the life expectancy of the power connector 1500. More specifically, the mating assembly 1544 further includes a link assembly 1570 that has a number of linking members 1572,1574 and a number of biasing elements (e.g., springs 1576,1578). The linking members 1572,1574 are each coupled to a respective one of the first end portions 1560, 1562. Furthermore, the linking members 1572,1574 each couple a respective one of the pins 1546,1548 to the ground pin 1550, and cooperate with the pins 1546,1548 and the ground pin 1550, as will be described in greater detail below. The springs 1576,1578 are each located on a corresponding one of the linking members 1572,1574. More specifically, the linking members 1572,1574 preferably, but without limitation, extend through the springs 1576,1578. When the mating assembly 1544 is in the first position (FIG. 17), the springs 1576,1578 exert respective biases in respective directions 1580,1582 on the respective pins 1546,1548 in order to maintain the pins 1546,1548 in the first position. In the first position (FIG. 17), the respective directions 1580, 1582 are into the load side electrical receptacle 1540. In other words, when the load side electrical receptacle 1540 is in the first position (FIG. 17), the springs 1576,1578 bias the pins 1546,1548 toward, and thus maintain the pins 1546, 1548 in, the first position (FIG. 17). This advantageously ensures that the potentially "hot" pins 1546,1548 remain internal, and are thus protected by, the insulative housing 1542.

Figure 18:
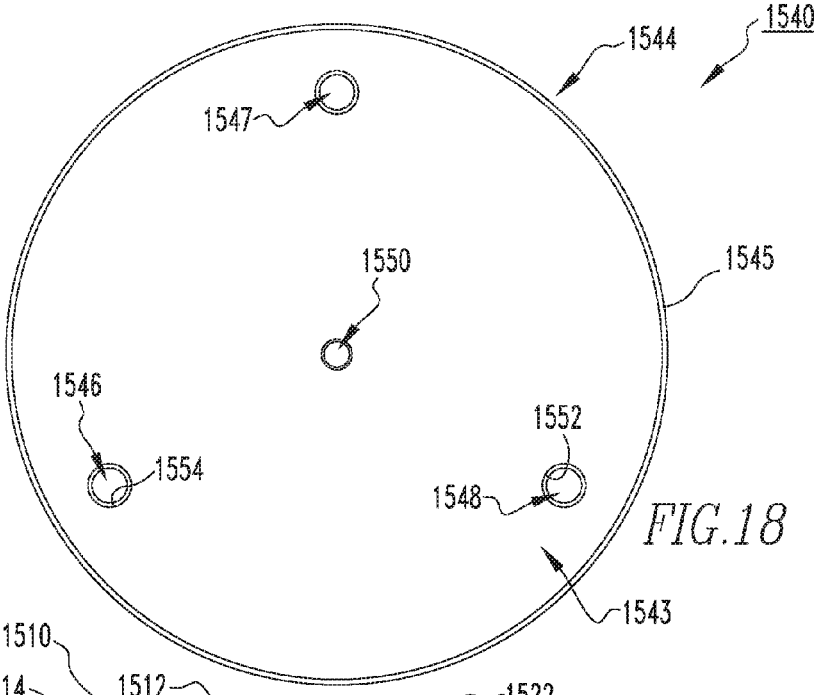
FIG. 18 is a top plan view of the electrical connection element of FIG. 17.
Figure 19:
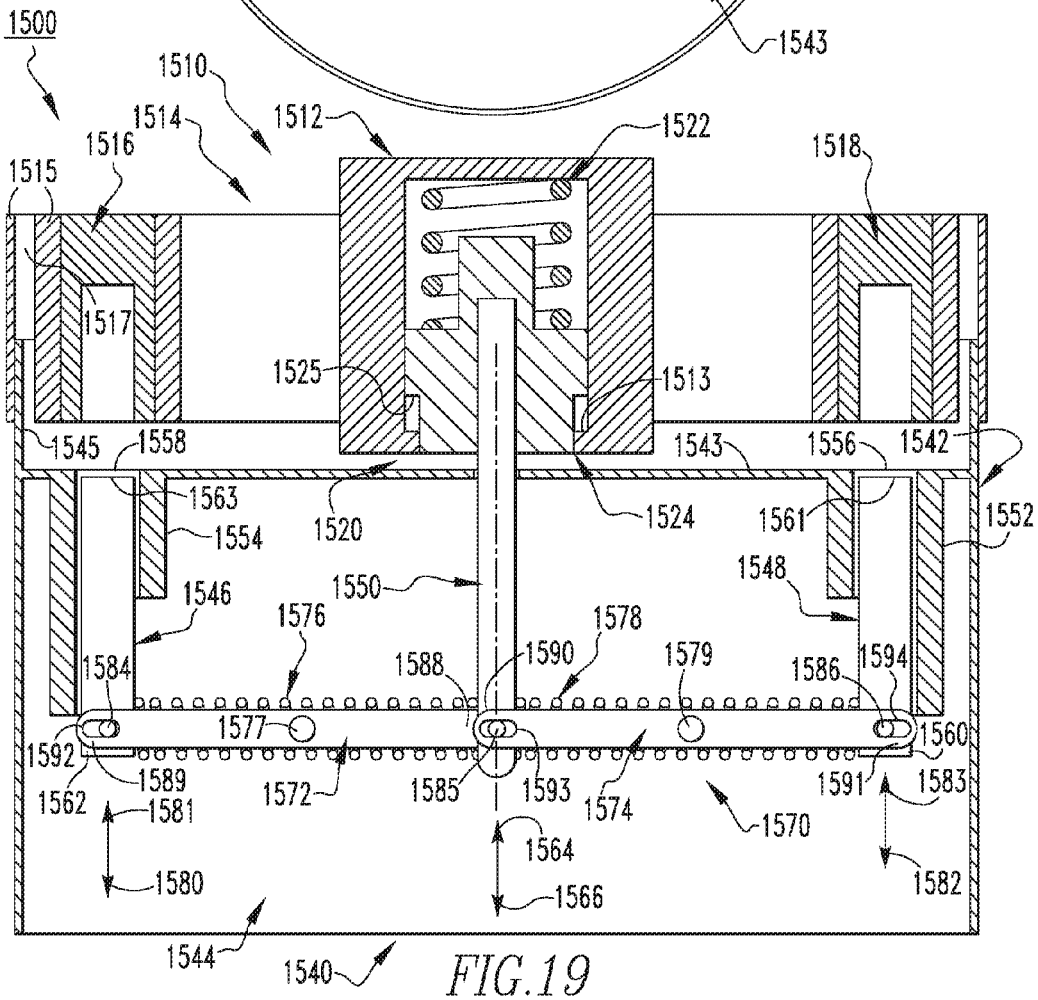
FIG. 19 is a simplified view of the portion of the power connector and electrical connection element therefor of FIG. 17, showing the second mating assembly in a third position.
Figure 20:
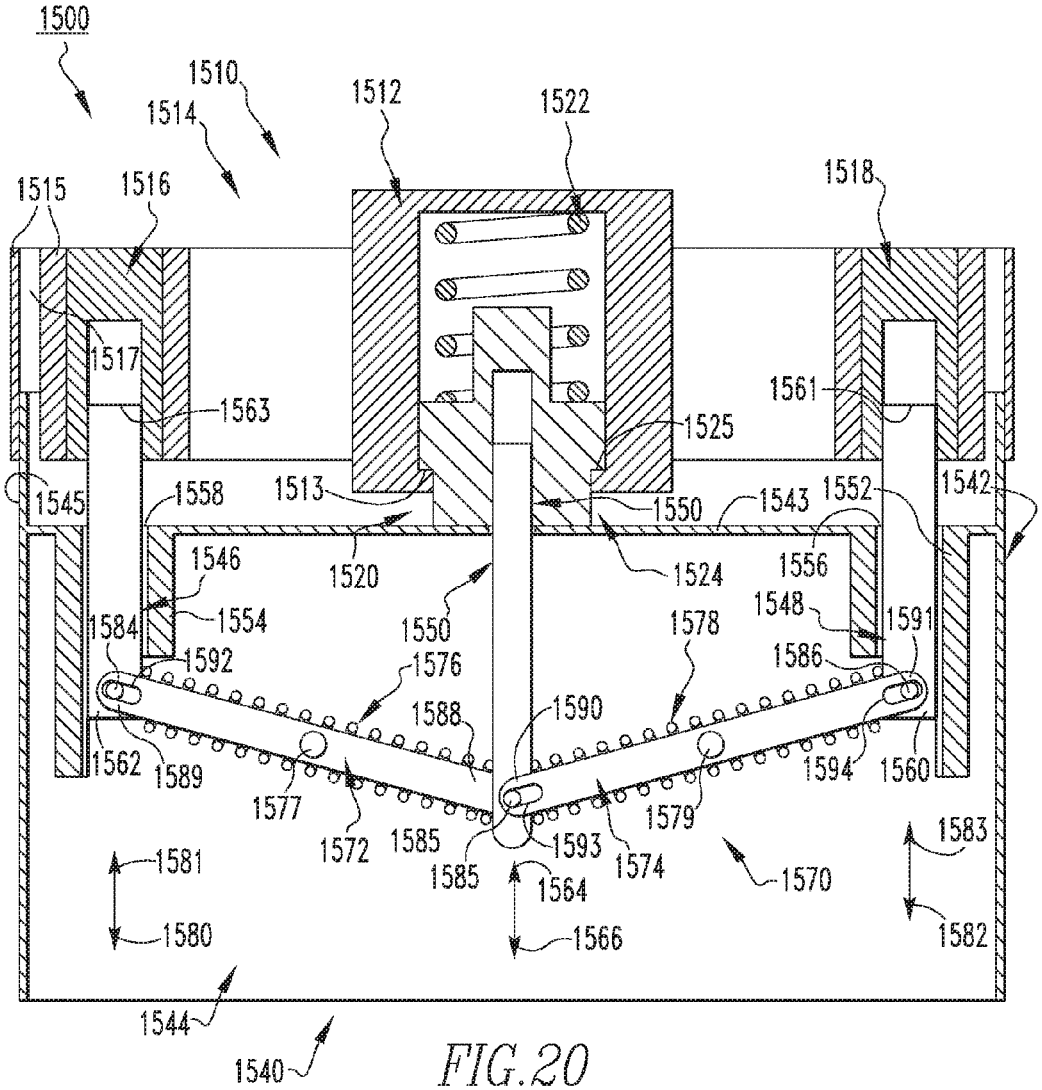
FIG. 20 is a simplified view of the portion of the power connector and electrical connection element therefor of FIG. 17, showing the second mating assembly in a second position.

As shown in FIG. 18, the mating assembly 1544 further includes another male conductor (e.g., phase pin 1547) that is structured to be electrically connected to a corresponding sleeve (not shown) of the line side electrical receptacle 1510 (FIGS. 17, 19 and 20). Thus, it will be appreciated that the pin 1547 is coupled to the ground pin 1550 by way of another linking member (not shown) of the link assembly 1570 and is biased toward the first position (FIG. 17) by another corresponding biasing element (not shown) of the link assembly 1570 in substantially the same manner in which the springs 1576,1578 bias the pins 1546,1548 toward the first position (FIG. 17). It will be appreciated that while the disclosed concept herein is being described in association with the three phase pins 1546,1547,1548, a suitable alternative power connector (not shown) may include any number of pins without departing from the scope of the disclosed concept. Continuing to refer to FIG. 18, the panel 1543 connects each of the receiving portions 1552,1554 (and the corresponding receiving portion of the pin 1547, shown but not indicated) to one another. As a result, the panel 1543 significantly obstructs entry into the load side electrical receptacle 1540. Furthermore, because the pins 1546,1547 (FIG. 18),1548 are behind the panel 1543 (i.e., are spaced a distance internal and/or spaced a distance from a top surface of the panel 1543), the potential for inadvertent dangerous contact is significantly lessened.

It will be appreciated that a method of assembling the power connector 1500 includes the steps of: providing the load side electrical receptacle 1540; providing the line side electrical receptacle 1510; aligning the sleeves 1516,1518 with the pins 1546,1547 (FIG. 18),1548; aligning the ground pin 1550 with the ground sleeve 1524; pushing (i.e., inserting) the ground pin 1550 into the ground sleeve 1524, thereby causing the pins 1546,1547 (FIG. 18),1548 to move independently with respect to the insulative housing 1542 and be partially located external the insulative housing 1542; and mechanically engaging the sleeves 1516,1518 with the pins 1546,1547 (FIG. 18),1548. The method further includes the step of driving the ground sleeve 1524 in the first direction 1564 into the insulative housing 1512 until the spring 1522 drives the ground sleeve 1524 in the second direction 1566 opposite the first direction 1564. Thus, it will be appreciated that when the mating assembly 1544 moves from the first position (FIG. 17) to the second position (FIG. 20), the pins 1546,1547 (FIG. 18),1548 slide at least partially through the corresponding distal portions 1556,1558 in order to be at least partially located external the insulative housing 1542.

FIG. 19 shows the mating assembly 1544 in a third position between the first position (FIG. 17) and the second position (FIG. 20). In this position, the ground pin 1550 has been inserted into the ground sleeve 1524 and has caused the ground sleeve 1524 to move independently with respect to the insulative housing 1512. Specifically, the ground sleeve 1524 has slid into the insulative housing 1512, thus being more enclosed by the insulative housing 1512 in the third position (FIG. 19) than the first position (FIG. 17). As a result, the spring 1522 is caused to compress. As the ground pin 1550 is being driven into the ground sleeve 1524, the ground pin 1550 is moving in the first direction 1564. When the ground pin 1550 moves in the first direction 1564, the mating assembly 1544 moves from the first position (FIG. 17) toward the third position (FIG. 19). When the ground pin 1550 moves in the second direction 1566, the mating assembly 1544 moves from the third position (FIG. 19) toward the second position (FIG. 20).

The compressed spring 1522 assists in moving the mating assembly 1544 from the third position (FIG. 19) toward the second position (FIG. 20). That is, when the mating assembly 1544 moves from the first position (FIG. 17) toward the third position (FIG. 19), the ground pin 1550 drives the ground sleeve 1524 in the first direction 1564 into the insulative housing 1512. When the mating assembly 1544 moves from the third position (FIG. 19) toward the second position (FIG. 20), the spring 1522 drives the ground sleeve 1524 in the second direction 1566 into the ground pin 1550 in order to force each of the pins 1546,1547 (FIG. 18),1548 into a corresponding one of the sleeves 1516,1518 by a mechanism with a snap-action motion.

In addition to the force of the spring 1522, the springs 1576,1578 advantageously assist in causing the mating assembly 1544 to move between positions by a mechanism with a snap-action motion. Specifically, as shown in the depicted orientation of FIG. 19 (i.e., the third position), the linking members 1572,1574, and thus the springs 1576,1578 have moved to a horizontal position. It will be appreciated that when the springs 1576,1578 are in the horizontal position (i.e., the third position, specifically where the springs 1576,1578 are oriented perpendicularly with respect to the pins 1546,1547 (FIG. 18),1548), the springs 1576, 1578 do not exert any bias on the respective pins 1546,1547 (FIG. 18),1548 in either the respective directions 1580,1582 or in respective directions 1581,1583 opposite the respective directions 1580,1582.

When the mating assembly 1544 moves from the first position (FIG. 17) toward the second position (FIG. 20), the spring 1522, and the springs 1576,1578, pass an equilibrium position (i.e., the third position of FIG. 19). Instantly after passing the equilibrium position (i.e., the third position of FIG. 19), the spring 1522 and the springs 1576,1578 drive the mating assembly 1544 to the second position (FIG. 20). That is, the spring 1522 releases stored energy and drives the ground sleeve 1524 into the ground pin 1550, which causes the linking members 1572,1574 to move beyond the third position (FIG. 19). Specifically, the linking members 1572, 1574 are pivotably coupled to the ground pin 1550. Thus, when the mating assembly 1544 moves from the third position (FIG. 19) toward the second position (FIG. 20), the linking members 1572,1574 continue to rotate (i.e., in the depicted orientation the linking member 1572 rotates in the clockwise direction, and the linking member 1574 rotates in the counterclockwise direction).

While the linking members 1572,1574 are rotating between positions (i.e., from the first position toward the third position, and from the third position toward the second position), the springs 1576,1578 are storing and releasing energy. That is, when the mating assembly 1544 moves from the first position (FIG. 17) toward the third position (FIG. 19), the springs 1576,1578 compress and store energy. When the mating assembly 1544 moves from the third position (FIG. 19) toward the second position (FIG. 20), the stored energy of the springs 1576,1578 is able to be released and drive the pins 1546,1547 (FIG. 18),1548 into the sleeves 1516,1518 by a mechanism with a snap-action motion. Accordingly, it will be appreciated that the driving step of the assembly method further includes the step of releasing the stored energy of the springs 1576,1578 when the ground sleeve 1524 begins to move in the second direction 1566, thereby forcing each of the pins 1546,1547 (FIG. 18),1548 into engagement with sleeves 1516,1518. Referring to FIG. 20, it will be appreciated that when the mating assembly 1544 is in the second position, the springs 1576,1578 exert respective biases on the respective pins 1546,1547 (FIG. 18),1548 in the respective directions 1581,1583 opposite the directions 1580,1582 in order to maintain the pins 1546, 1547 (FIG. 18),1548 in the second position.

In order to allow the mating assembly 1544 to move between positions, the link assembly 1570 further includes a number of sliding members 1584,1586 each coupled to a corresponding one of the pins 1546,1547 (FIG. 18),1548, and at least one other sliding member 1585 coupled to the ground pin 1550. The linking members 1572,1574 each have a respective first end portion 1588,1590 and a respective second end portion 1589,1591 located opposite and distal the respective first end portion 1588,1590. The first end portions 1588,1590 each have a respective slot (for ease of illustration, only slot 1593 of the first end portion 1590 is depicted) that (via the sliding member 1585) allows the first end portions 1588,1590 to be pivotably coupled to the ground pin 1550. The second end portions 1589,1591 each have a respective slot 1592,1594. In operation, each sliding member 1584,1585,1586 is structured to slide within a respective slot 1592,1593,1594 (and the slot of the first end portion 1588) in order to allow the mating assembly 1544 to move between the first position (FIG. 17) and the second position (FIG. 20). Additionally, the linking members 1572, 1574 each have a respective pivoting location 1577,1579 located generally midway between the respective first end portions 1588,1590 and the second end portions 1589,1591. It will be appreciated that when the mating assembly 1544 moves between positions, the pivoting locations 1577,1579 remain fixed with respect to the insulative housing 1542. That is, the linking members 1572,1574 rotate about (i.e., with respect to) the pivoting locations 1577,1579.

The insulative housing 1512 of the line side electrical receptacle 1510 includes an annular-shaped insulative receiving portion 1515 having a slot 1517. As shown in FIG. 20, when the pins 1546,1547 (FIG. 18),1548 have been inserted into the sleeves 1516,1518, the peripheral rim 1545 extends into the slot 1517 and advantageously provides a protective barrier against inadvertent contact with the electrically connected pins 1546,1547 (FIG. 18),1548. Additionally, when the mating assembly 1544 is in this second position, each of the pins 1546,1547 (FIG. 18),1548 extends into a corresponding one of the sleeves 1516,1518 in order to electrically connect the line side electrical receptacle 1510 to the load side electrical receptacle 1540.

Additionally, although the disclosed concept has been described in association with the mating assembly 1544 moving between positions in order to allow the pins 1546, 1547 (FIG. 18),1548 to be inserted into the sleeves 1516, 1518, it will be appreciated that a suitable alternative power connector (not shown) may employ the load side electrical receptacle 1540 and another electrical component that includes phase pins (not shown) that mechanically engage the pins 1546,1547 (FIG. 18),1548 instead of sleeves, without departing from the scope of the disclosed concept.

Accordingly, it will be appreciated that the disclosed concept provides for an improved (e.g., without limitation, better-protected, longer-lasting) power connector 1500, and electrical connection element 1540 and assembly method therefor, which among other benefits, encloses potentially "hot" pins 1546,1547,1548 within an insulative housing 1542, thereby protecting operators from dangers associated with inadvertent exposure to the pins 1546,1547,1548. Additionally, because assembly of the power connector 1500 involves a mechanism with a snap-action motion, life expectancy of the power connector 1500 is improved, as electrical arcing, heat dissipation, and teasing are all minimized.

Figure 21:
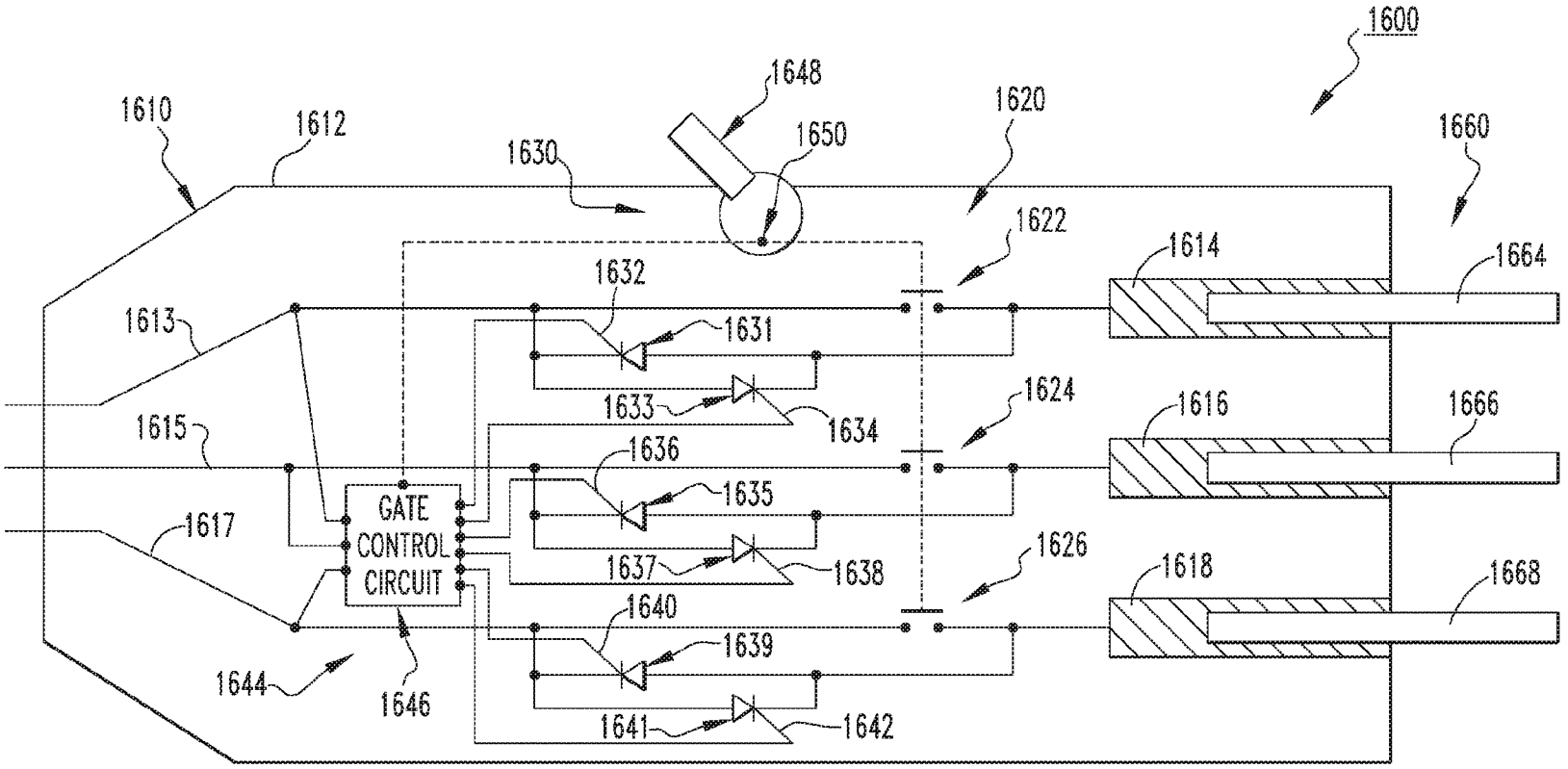
FIG. 21 is a simplified view of a portion of a power connector and electrical connection element therefor, in accordance with another non-limiting embodiment of the disclosed concept.

In addition to the foregoing, FIG. 21 shows one non-limiting example embodiment of an alternative power connector 1600 which includes many of the same components as the power connector 100 (FIGS. 1 and 2), and many of the components are labeled with like reference numbers. As shown, the contact assembly 1620 includes a number of sets of separable contacts 1622,1624,1626 that are each electrically connected to at least one of the sleeves 1614,1616, 1618. However, in addition to including the contact assembly 1620, the line side electrical receptacle 1610 further includes an arc suppression system 1630 that advantageously suppresses arcing in the line side electrical receptacle 1610 when the contact assembly 1620 moves between an OPEN position and a CLOSED position.

The arc suppression system 1630 preferably includes a number of electronic devices such as the example SCRs 1631,1633,1635,1637,1639,1641, and a control mechanism 1644 for controlling the SCRs 1631,1633,1635,1637,1639, 1641. Although the concept disclosed herein is being described in association with the SCRs 1631,1633,1635, 1637,1639,1641 as the electronic devices, it will be appreciated that any suitable alternative electronic device (e.g., FETs and/or IGBTs) (not shown) may be employed without departing from the scope of the disclosed concept. In operation, when the contact assembly 1620 moves between the OPEN position and the CLOSED position, the control mechanism 1644 redirects current from each of the sets of separable contacts 1622,1624,1626 to a corresponding one of the SCRs 1631,1633, 1635,1637,1639,1641 in order to suppress arcing across the respective sets of separable contacts 1622,1624,1626.

More specifically, the SCRs 1631,1633,1635,1637,1639, 1641 carry current with a voltage significantly smaller than typical arc voltage. For example and without limitation, the SCRs 1631,1633,1635,1637,1639,1641 preferably carry current with a voltage of around 1 volt, whereas the voltage over an arc is generally greater than 12 volts. Because current follows the path of least resistance, the current will be redirected from the respective sets of separable contacts 1622,1624,1626 to the respective SCRs 1631,1633,1635, 1637,1639,1641. Thus, it will be appreciated that the arc suppression system 1630 ensures that the sets of separable contacts 1622,1624,1626 do not have to withstand significant arcing. Accordingly, the arc suppression system 1630 advantageously allows the size of the sets of separable contacts 1622,1624,1626 to be relatively small because arc erosion across the sets of separable contacts 1622,1624,1626 is significantly lessened. As a result, material can be saved and costs thereby reduced.

Each of the SCRs 1631,1633,1635,1637,1639,1641 has a respective gate 1632,1634,1636,1638,1640,1642. The control mechanism 1644 includes a gate control circuit 1646 and an operating mechanism (e.g., without limitation, operating lever 1648). The gate control circuit 1646 is structured to move each of the respective gates 1632,1634,1636,1638, 1640,1642 between an ON position and an OFF position in order to redirect current from the respective sets of separable contacts 1622,1624,1626 to a corresponding one of the SCRs 1631,1633,1635,1637,1639,1641. The gate control circuit 1646 causes the gates 1632,1634, 1636,1638,1640, 1642 to move between positions in response to any one of a number of input control signals, which include, for example, the position of the operating lever 1648, current magnitude, voltage across the separable contacts 1622,1624, 1626, and/or time duration after the SCR's 1631,1633,1635, 1637,1639,1641 have been turned ON.

For example, when the sleeves 1614,1616,1618 and the pins 1664,1666,1668 are engaged, and the separable contacts 1622,1624,1626 move between the OPEN position and the CLOSED position, a bounce and an arc voltage is produced, which sends a signal to the gate control circuit 1646 to cause the gates 1632,1634,1636,1638,1640,1642 to move from the OFF position to the ON position. Furthermore, a timer signal causes the gates 1632,1634,1636,1638, 1640,1642 to move to the OFF position after the current is carried by the SCR's 1631,1633,1635, 1637,1639,1641. Thus, at the instant when the contact assembly 1620 moves between the OPEN position and the CLOSED position (i.e., to disconnect power or to connect power, responsive to actuation of the operating lever 1648 after the sleeves 1614,1616,1618 and the pins 1664,1666, 1668 have been mechanically coupled and electrically connected, as discussed above), the gate control circuit 1646 redirects current to a respective one of the SCRs 1631,1633,1635,1637,1639, 1641. In this manner, arcing across the respective sets of separable contacts 1622,1624,1626 is advantageously suppressed.

The operating lever 1648, which in the example shown is coupled to the housing 1612 of the line side electrical receptacle 1610, is structured to move the contact assembly 1620 between the OPEN position and the CLOSED position. Additionally, the operating lever 1648 has a sensor 1650 that is structured to monitor circuit status of the contact assembly 1620. The sensor 1650 is electrically connected to the gate control circuit 1646 (e.g., without limitation, wirelessly connected) in order to provide indication of circuit status to the gate control circuit 1646. In other words, when the operating lever 1648 opens or closes the contact assembly 1620, the sensor 1650 sends a signal to the gate control circuit 1646, which in turn causes each of the respective gates 1632,1634,1636,1638,1640,1642 to move from the OFF position to the ON position in order for current to be redirected and arcing to be advantageously suppressed.

Additionally, the housing 1612 of the line side electrical receptacle 1610 further includes a number of power cables 1613,1615,1617 each electrically connected to a corresponding one of the sleeves 1614,1616,1618. The gate control circuit 1646 is electrically connected to at least one of the power cables 1613,1615,1617 in order to be powered thereby. In this manner, the gate control circuit 1646 is advantageously able to be powered by the line side electrical receptacle 1610 without the need to employ a separate powering mechanism.

The line side electrical receptacle 1610 allows current to flow in two opposing directions (i.e., in a first direction out of the line side electrical receptacle 1610 and into the load side electrical receptacle 1660, and in a second direction into the line side electrical receptacle 1610 from the load side electrical receptacle 1660). Additionally, the SCRs 1631, 1633,1635, 1637,1639,1641 are electrically connected in parallel with the sets of separable contacts 1622,1624,1626. More specifically, each of the respective first SCRs 1631, 1635,1639 are electrically connected in parallel with a respective one of the second SCRs 1633,1637,1641 and a respective one of the sets of separable contacts 1622,1624, 1626. Thus, responsive to current flowing in the first direction from the line side electrical receptacle 1610 into the load side electrical receptacle 1660, current is redirected into the first SCRs 1631,1635,1639 when the contact assembly 1620 moves between the OPEN position and the CLOSED position. Similarly, responsive to current flowing in the second direction from the load side electrical receptacle 1660 into the line side electrical receptacle 1610, current is redirected into the second SCRs 1633,1637,1641 when the contact assembly 1620 moves between the OPEN position and the CLOSED position. Although the concept disclosed herein is being described in association with two respective SCRs electrically connected in parallel to one set of separable contacts, it will be appreciated that a single SCR (not shown) could be electrically connected in parallel to a single set of separable contacts (not shown) in a suitable alternative power connector (e.g., without limitation, a power connector for direct current with a fixed polarity, not shown).

Additionally, an associated method of suppressing arcing in the power connector 1600 includes the steps of: providing the load side electrical receptacle 1660; providing the line side electrical receptacle 1610; electrically connecting the pins 1664,1666,1668 to the sleeves 1614,1616,1618; moving the contact assembly 1620 between an OPEN position and a CLOSED position; and redirecting current with the control mechanism 1644 from the respective sets of separable contacts 1622,1624,1626 to a corresponding one of the SCRs 1631,1633,1635,1637, 1639,1641. Furthermore, the redirecting step includes moving the respective gates 1632, 1634, 1636,1638,1640,1642 from an OFF position to an ON position in order to redirect current from the respective sets of separable contacts 1622,1624,1626 to the corresponding one of the SCRs 1631,1633,1635,1637,1639,1641. The example method also includes the steps of: moving the contact assembly 1620 between the OPEN position and the CLOSED position with the operating lever 1648; sending a signal to the gate control circuit 1646 with the sensor 1650 in order to provide a circuit status indication; and either (a) redirecting current with the control mechanism 1644 from the respective sets of separable contacts 1622,1624,1626 to the first SCRs 1631,1635,1639 when current flows in the first direction, or (b) redirecting current with the control mechanism 1644 from the respective sets of separable contacts 1622,1624,1626 to the second SCRs 1633,1637, 1641 when current flows in the second direction.

Figure 22:
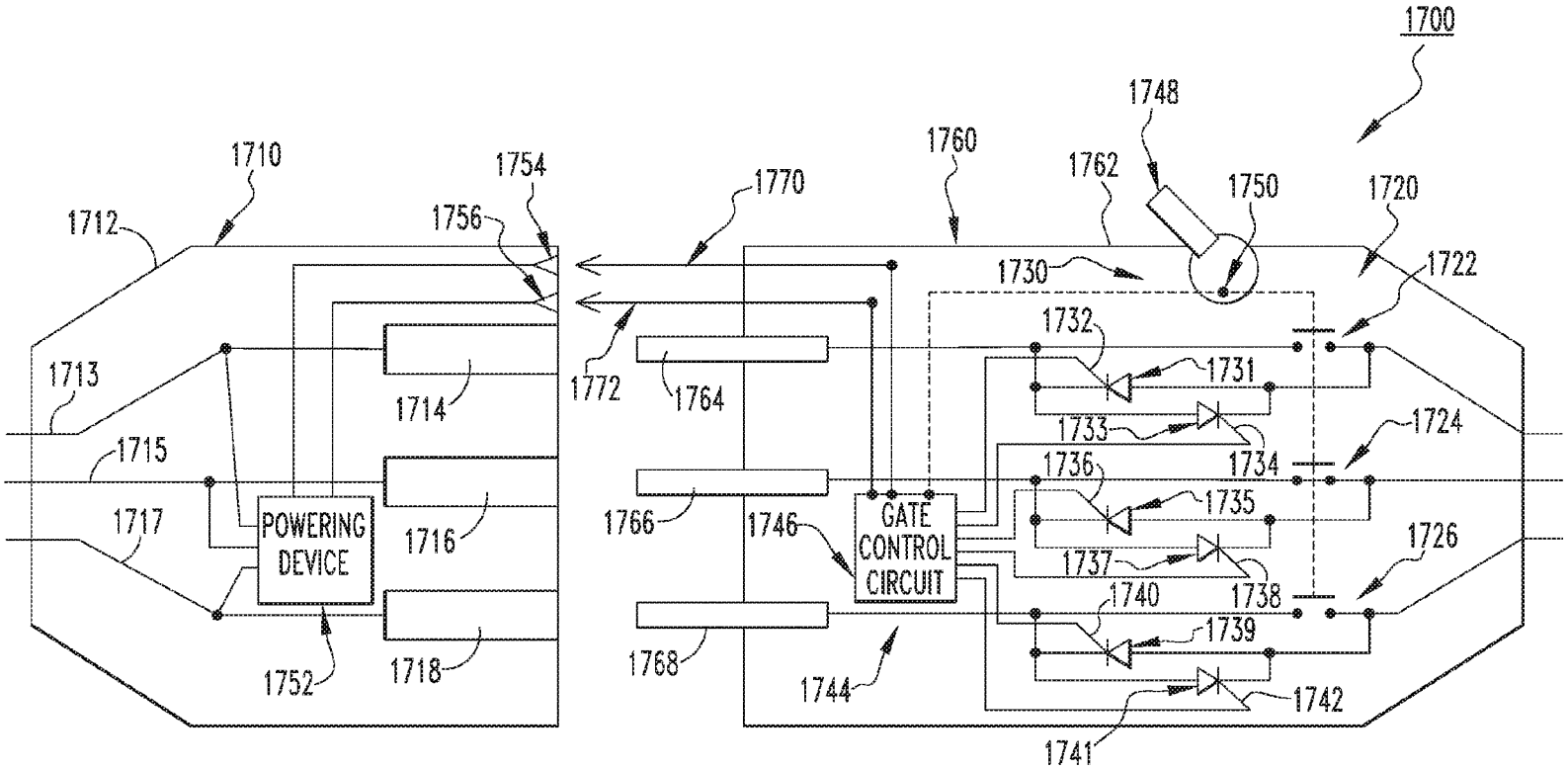
FIG. 22 is a simplified view of a power connector and electrical connection element therefor, in accordance with another non-limiting embodiment of the disclosed concept.

In addition to the foregoing, FIG. 22 shows another non-limiting example embodiment of an alternative power connector 1700 which includes many of the same components as the power connector 1600 (FIG. 21), and like components are labeled with like reference numbers. As shown, the arc suppression system 1730 is located in the load side electrical receptacle 1760. Furthermore, the housing 1762 of the load side electrical receptacle 1760 includes a number of electrical mating members, such as the example male conductors (e.g., without limitation, power pins 1770, 1772) electrically connected to the gate control circuit 1746. The line side electrical receptacle 1710 also includes a number of electrical mating members, such as the example female conductors (e.g., without limitation, power sleeves 1754,1756), and a powering device 1752. The powering device 1752 is electrically connected to the power cables 1713,1715,1717 and the power sleeves 1754,1756, and is operable to transfer power from the power cables 1713, 1715,1717 to the power sleeves 1754,1756.

In operation, each of the power sleeves 1754,1756 is electrically connected to a corresponding one of the power pins 1770,1772, thereby allowing the power cables 1713, 1715,1717 (i.e., by way of the powering device 1752) to provide power to the gate control circuit 1746. It will be appreciated that the arc suppression system 1730 provides substantially the same advantages for the load side electrical receptacle 1760 as the arc suppression system 1630 (FIG. 21) provides for the line side electrical receptacle 1610 (FIG. 21). That is, when the contact assembly 1720 moves between the OPEN position and the CLOSED position (i.e., responsive to movement of the operating lever 1748), the gate control circuit 1746 redirects current to the SCRs 1731,1733,1735,1737,1739,1741 in order to advantageously suppress arcing across the respective sets of separable contacts 1722,1724,1726. Accordingly, arc suppression of a contact assembly (i.e., the contact assemblies 1620,1720) is advantageously able to be achieved in a line side electrical receptacle (i.e., the line side electrical receptacle 1610) and a load side electrical receptacle (i.e., the load side electrical receptacle 1760).

Additionally, although the power connectors 1600,1700 have been described in association with the operating levers 1648,1748 as the operating mechanisms, it will be appreciated that a suitable alternative power connector (not shown) may employ a suitable alternative operating mechanism (i.e., the operating mechanisms 330,430,630,830,930 described above) in order to perform the desired function of opening and closing a respective contact assembly (not shown). Furthermore, although the arc suppression systems 1630,1730 have been described in association with the line side electrical receptacle 1610 and the load side electrical receptacle 1760, respectively, it will be appreciated that a suitable alternative arc suppression system (not shown) could be employed with a suitable alternative adapter (not shown) that is substantially similar to the adapter 1480 (FIG. 16).

Accordingly, it will be appreciated that the disclosed concept provides for an improved (e.g., without limitation, longer-lasting, better-protected, less expensive) power connector 1600,1700, and electrical connection element 1610, 1760 and arc suppression method therefor, which among other benefits, redirects current from a respective set of separable contacts 1622,1624,1626,1722,1724,1726 to a respective electronic device 1631,1633,1635, 1637,1639, 1641,1731,1733,1735,1737,1739,1741 in order to advantageously suppress arcing across the respective sets of separable contacts 1622,1624,1626,1722,1724,1726. Thus, the size of each of the respective sets of separable contacts 1622,1624,1626,1722,1724,1726 can advantageously be made relatively small due to the significantly reduced arc erosion, thereby saving material and reducing cost.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical connection element for a power connector, said power connector comprising an electrical component including a first insulative inner housing, a first insulative outer housing, and a first mating assembly having a number of first electrical mating members structured to be substantially enclosed by said first insulative inner housing and said fist insulative outer housing, said electrical connection element comprising:

a second insulative housing having an extension portion structured to extend into said electrical component between said first insulative inner housing and said first insulative outer housing: and a second mating assembly comprising a number of second electrical mating members structured to be electrically connected to said number of first electrical mating members, wherein said second mating assembly is structured to move between a first position corresponding to said number of second electrical mating members being substantially enclosed by said second insulative housing, and a second position corresponding to said number of second electrical mating members being partially disposed external said second insulative housing;

wherein said number of second electrical mating members is a number of male conductors; wherein each of said number of male conductors has a first end portion and a second end portion disposed opposite and distal the first end portion; wherein said second insulative housing comprises an insulative panel and a number of insulative receiving portion each extending from said insulative panel toward a respective first end portion; wherein each of said number of male conductors at least partially extends through a corresponding one of said number of insulative receiving portions; wherein said extension portion is annular-shaped; and wherein said insulative panel is disposed generally internal the extension portion.

2. The electrical connection element of claim 1 wherein each respective insulative receiving portion has a distal portion disposed at said insulative panel; wherein, when said second mating assembly is disposed in the first position, each respective second end portion is disposed between a corresponding first end portion and a corresponding distal portion; and wherein, when said second mating assembly moves from the first position toward the second position, each respective male conductor slides at least partially through said corresponding distal portion in order to be at least partially disposed external said second insulative housing.

3. The electrical connection element of claim 1 wherein said panel is generally planar; and wherein said panel connects each of the receiving portions to one another.

4. A power connector comprising:

an electrical component comprising:

a first insulative inner housing, a first insulative outer housing, and a first mating assembly comprising a number of first electrical mating members structured to be substantially enclosed by said first insulative inner housing and said first insulative outer housing, and an electrical connection element comprising:

a second insulative housing having an extension portion structured to extend into said electrical component between said first insulative inner housing and said first insulative outer housing, and a second mating assembly comprising a number of second electrical mating members structured to be electrically connected to said number of first electrical mating members, wherein said second mating assembly is structured to move between a first position corresponding to said number of second electrical mating members being substantially enclosed by said second insulative housing, and a second position corresponding to said number of second electrical mating members being partially disposed external said second insulative housing;

wherein said number of first electrical mating members is a number of female conductors; wherein said number of second electrical mating members is a number of male conductors; wherein, when said second mating assembly is disposed in the second position, each of said number of male conductors extends into a corresponding one of said number of female conductors in order to electrically connect said electrical connection element to said electrical component; wherein each of said number of male conductors has a first end portion and a second end portion disposed opposite and distal the first end portion; wherein said second insulative housing comprises an insulative panel and a number of insulative receiving portions each extending from said insulative panel toward a respective first end portion; wherein each of said number of male conductors at least partially extends through a corresponding one of said number insulative receiving portions; wherein said extension portion is annular-shaped; wherein said insulative panel is disposed generally internal the extension portion; and wherein, when said second mating assembly is in the second position, the extension portion extends into said electrical component between said first insulative inner housing and said first insulative outer housing.

5. The power connector of claim 4 wherein said number of female conductors is a plurality of sleeves; and wherein said number of male conductors is a plurality of pins.

6. The power connector of claim 4 wherein said electrical component is a line side electrical receptacle; and wherein said electrical connection element is a load side electrical receptacle.

7. The power connector of claim 4 wherein each respective insulative receiving portion has a distal portion disposed at said insulative panel; wherein, when said second mating assembly is disposed in the first position, each respective second end portion is disposed between a corresponding first end portion and a corresponding distal portion; and wherein, when said second mating assembly moves from the first position toward the second position, each respective male conductor slides at least partially through said corresponding distal portion in order to be at least partially disposed external said second insulative housing.

8. A method of assembling a power connector comprising the steps of:

providing an electrical connection element comprising a first insulative housing and a number of first electrical mating members substantially enclosed by said first insulative housing, said first insulative housing having an extension portion;

providing an electrical component comprising a second insulative inner housing, a second insulative outer housing, and a number of second electrical mating members structured to be substantially enclosed by said second insulative inner housing and said second insulative outer housing, said extension portion being structured to extend into said electrical component between said second insulative inner housing and said second insulative outer housing;

aligning said number of first electrical mating members with said number of second electrical mating members;

pushing said electrical connection element and said electrical component toward one another, thereby causing said number of first electrical mating members to move independently with respect to said first insulative housing and be partially disposed external said first insulative housing; and mechanically engaging said number of second electrical mating members with said number of first electrical mating members;

wherein said extension portion is annular-shaped; and wherein the pushing step further comprises:

inserting the extension portion into said electrical component between said second insulative inner housing and said second insulative outer housing.

9. The method of claim 8 wherein said number of first electrical mating members is a first plurality of pins; and wherein said number of second electrical mating members is a second plurality of pins.

10. The method of claim 8 wherein said electrical connection element is a load side electrical receptacle; and wherein said electrical component is a line side electrical receptacle.

11. The method of claim 8 wherein said number of first electrical mating members is a number of male conductors; and wherein said number of second electrical mating members is a number of female conductors.

12. The method of claim 11 wherein each of said number of male conductors has a first end portion and a second end portion disposed opposite and distal the first end portion; wherein said first insulative housing comprises an insulative panel and a number of insulative receiving portions each extending from said insulative panel toward a respective first end portion; and wherein the pushing step further comprises:

moving each of said number of male conductors at least partially through said insulative panel; and sliding each of said number of male conductors at least partially through a corresponding one of said number of insulative receiving portions.

* * * * *